US012509205B2

(12) United States Patent
Sawano et al.

(10) Patent No.: US 12,509,205 B2
(45) Date of Patent: Dec. 30, 2025

(54) SHIP CONTROL METHOD, SHIP CONTROL PROGRAM, AND SHIP CONTROL SYSTEM, AND SHIP

(71) Applicant: Yanmar Holdings Co., Ltd., Osaka (JP)

(72) Inventors: Tomohiro Sawano, Osaka (JP); Toru Honjo, Osaka (JP); Kenji Ogata, Osaka (JP); Atsushi Yoshida, Osaka (JP); Yosuke Shimizu, Osaka (JP); Gakuji Tamura, Osaka (JP); Yuki Kajikawa, Osaka (JP); Jumpei Sawada, Osaka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 742 days.

(21) Appl. No.: 17/860,963

(22) Filed: Jul. 8, 2022

(65) Prior Publication Data

US 2023/0020778 A1 Jan. 19, 2023

(30) Foreign Application Priority Data

Jul. 12, 2021 (JP) ..... 2021-114815
Jul. 12, 2021 (JP) ..... 2021-114816
Jul. 12, 2021 (JP) ..... 2021-114817

(51) Int. Cl.
*B63H 21/21* (2006.01)
*B63H 21/14* (2006.01)
(Continued)

(52) U.S. Cl.
CPC ..... *B63H 21/21* (2013.01); *B63H 21/14* (2013.01); *B63H 21/17* (2013.01); *B63H 23/28* (2013.01);
(Continued)

(58) Field of Classification Search
CPC ..... B63H 21/21; B63H 21/14; B63H 21/17; B63H 23/28; B63H 23/30; B63H 2021/216; B63H 2021/219
See application file for complete search history.

(56) References Cited

U.S. PATENT DOCUMENTS 8,357,019 B2 1/2013 Frizon et al.
2021/0139123 A1 5/2021 Osara et al.
2021/0253214 A1* 8/2021 Kadobayashi ..... B63H 1/14

FOREIGN PATENT DOCUMENTS

DE 102019214572 A1 3/2021
EP 1897801 A2 * 3/2008 ..... B63H 20/00
(Continued)

OTHER PUBLICATIONS

Extended European Search Report dated Jan. 19, 2023 issued in EP Application No. 22183994.7.
(Continued)

*Primary Examiner* — Stephen P Avila
(74) *Attorney, Agent, or Firm* — NORTON ROSE FULBRIGHT US LLP

(57) ABSTRACT

The control method of a ship is used for the ship. The ship is equipped with a plurality of power sources including a first power source and a second power source, and has a plurality of propulsion modes in which a power source used for propulsion of a hull is different between the plurality of power sources. The control method of the ship includes adjusting an output value related to a propulsive force of a hull to a value corresponding to an operation amount of an operation acceptor and changing a correspondence relation between the operation amount and the output value in accordance with a propulsion mode.

17 Claims, 25 Drawing Sheets

(51) Int. Cl.
*B63H 21/17* (2006.01)
*B63H 23/28* (2006.01)
*B63H 23/30* (2006.01)

(52) U.S. Cl.
CPC ..... *B63H 23/30* (2013.01); *B63H 2021/216* (2013.01)

(56) References Cited

FOREIGN PATENT DOCUMENTS

| | | | | |
|---|---|---|---|---|
| JP | 2004-255972 | A | 9/2004 | |
| JP | 2011063256 | A | 3/2011 | |
| JP | 2019-199148 | A | 11/2019 | |
| JP | 2020029185 | A | 2/2020 | |
| WO | WO-0247974 | A1 * | 6/2002 | ..... B63H 21/20 |
| WO | 2017149589 | A1 | 9/2017 | |
| WO | 2019111460 | A1 | 6/2019 | |
| WO | 2020053939 | A1 | 3/2020 | |

OTHER PUBLICATIONS

Japanese Office Action dated Oct. 1, 2024 issued in JP Application No. 2021-114815.
Japanese Office Action dated Sep. 12, 2024, issued in JP Application No. 2021-114816.
Japanese Office Action dated Sep. 25, 2024, issued in JP Application No. 2021-114817.

* cited by examiner

SHIP CONTROL METHOD, SHIP CONTROL PROGRAM, AND SHIP CONTROL SYSTEM, AND SHIP

CROSS-REFERENCE TO RELATED APPLICATIONS

This application is claims priority under 35 U.S.C. § 119 to JP Application Nos. 2021-114815 filed Jul. 12, 2021, 2021-114816 filed Jul. 12, 2021, and 2021-114817 filed Jul. 12, 2021, the entire contents of which are hereby incorporated by references.

TECHNICAL FIELD

The present disclosure relates to a ship control method, a ship control program, a ship control system, and a ship having a plurality of propulsion modes in which a power source used for propulsion of a hull is different among the plurality of power sources.

BACKGROUND ART

As a related art, a ship is known in which an engine and a motor (electric equipment) are equipped and on which a hybrid system having a plurality of propulsion modes (drive forms) including engine navigation, engine and motor navigation, and motor navigation is mounted (see, for example, Patent Document 1). Ships according to the related art further include a power transmitter interposed between a plurality of power sources including an engine and a motor and a propeller, and the propeller can be driven by both the engine and the motor. Here, the hybrid system is configured to switch the above propulsion mode by switching a clutch included in the power transmitter.

In ships according to the related art, an operating lever is operated to adjust the operating position, thereby switching the forward, neutral, and backward movements of a hull and adjusting the driving force (rpm) of the engine or the driving force (rpm) of the motor.

PRIOR ART DOCUMENT

Patent Document

Patent Document 1: Japanese Unexamined Patent Application Publication No. 2004-255972

SUMMARY OF INVENTION

Technical Problem

As in the related art described above, in a ship equipped with a plurality of power sources with different maximum outputs, when the hull is switched between forward, neutral, and backward movements in accordance with the operation amount (operation position) of one operation acceptor (operating lever), the operability of the operation acceptor may be sacrificed depending on the power source. For example, in navigation with a motor having a relatively low maximum output, only a part of the operating range (movable range) of the operation acceptor is used to adjust the motor rpm, and the remaining part may not be reflected in the motor rpm even if the operation amount of the operation acceptor changes.

An object of the present disclosure is to provide a ship control method, a ship control program, a ship control system, and a ship that can easily improve the operability of an operation acceptor.

Solution to Problem

A ship control method according to one aspect of the present disclosure is used for a ship including a plurality of power sources including a first power source and a second power source, and having a plurality of propulsion modes in which a power source used for propulsion of a hull is different among the plurality of power sources. The ship control method includes adjusting an output value related to a propulsive force of the hull to a value corresponding to an operation amount of an operation acceptor and changing a correspondence relation between the operation amount and the output value in accordance with the propulsion modes.

A ship control method according to one aspect of the present disclosure is used for a ship including a plurality of power sources including an engine and a motor, having a plurality of propulsion modes in which a power source used for propulsion of a hull is different among the plurality of power sources, and being provided with a clutch at least between the engine and an output section that outputs a propulsive force of the hull. The plurality of propulsion modes include a hybrid propulsion mode in which both the engine and the motor are used for propulsion of the hull and a motor propulsion mode in which the motor is used for propulsion of the hull. The ship control method includes, when the motor propulsion mode is switched to the hybrid propulsion mode, synchronizing revolutions per minute of the engine with revolutions per minute of the motor before the clutch is switched from a disconnected state to a transmission state and controlling a torque of the motor during a torque control period after the revolutions per minute is synchronized.

A ship control method according to another aspect of the present disclosure is used for a ship including a plurality of power sources including an engine and a motor, having a plurality of propulsion modes in which a power source used for propulsion of a hull is different among the plurality of power sources, and being provided with a clutch at least between the engine and an output section that outputs a propulsive force of the hull. The plurality of propulsion modes include a hybrid propulsion mode in which both the engine and the motor are used for propulsion of the hull and a motor propulsion mode in which the motor is used for propulsion of the hull. The ship control method includes, when the hybrid propulsion mode is switched to the motor propulsion mode, before the clutch is switched from a transmission state to a disconnected state, controlling a torque of the motor.

A ship control method according to one aspect of the present disclosure is used for a ship including a plurality of power sources including an engine and a motor, having a plurality of propulsion modes in which a power source used for propulsion of a hull is different among the plurality of power sources, and being provided with a meshing clutch between the motor and an other device including at least one of an output section that generates a propulsive force of the hull and the engine. The ship control method includes, controlling revolutions per minute of the motor before a motor side revolving body on a side of the motor and an other side revolving body on a side of the other device in the clutch are fitted, to thereby set a difference in revolution per minute between the motor side revolving body and the other side revolving body.

A ship control program according to one aspect of the present disclosure is a program for causing one or more processors to execute the ship control method.

A ship control system according to one aspect of the present disclosure is used for a ship and includes an adjustment processor and a change processor. The ship includes a plurality of power sources including a first power source and a second power source, and has a plurality of propulsion modes in which a power source used for propulsion of a hull is different among the plurality of power sources. The adjustment processor adjusts the output value related to the propulsive force of the hull to a value corresponding to the operation amount of an operation acceptor. The change processor changes a correspondence relation between the operation amount and the output value in accordance with the propulsion modes.

A ship control system according to one aspect of the present disclosure is used for a ship and includes a motor rpm processor. The ship includes a plurality of power sources including an engine and a motor, has a plurality of propulsion modes in which a power source used for propulsion of a hull is different among the plurality of power sources, and is provided with a meshing clutch between the motor and an other device including at least one of an output section that generates a propulsive force of the hull and the engine. The motor rpm processor controls revolutions per minute of the motor before a motor side revolving body on a side of the motor and an other side revolving body on a side of the other device in the clutch are fitted, to thereby set a difference in revolution per minute between the motor side revolving body and the other side revolving body.

A ship control system according to one aspect of the present disclosure is used for a ship and includes a motor rpm processor. The ship includes a plurality of power sources including an engine and a motor, has a plurality of propulsion modes in which a power source used for propulsion of a hull is different among the plurality of power sources, and is provided with a meshing clutch between the motor and an other device including at least one of an output section that generates a propulsive force of the hull and the engine. The motor rpm processor controls revolutions per minute of the motor before a motor side revolving body on a side of the motor and an other side revolving body on a side of the other device in the clutch are fitted, to thereby set a difference in revolution per minute between the motor side revolving body and the other side revolving body.

A ship according to one aspect of the present disclosure includes the ship control system and the hull.

Advantageous Effects of Invention

According to the present invention, it is possible to provide a ship control method, a ship control program, a ship control system, and a ship that can easily improve the operability of an operation acceptor.

DESCRIPTION OF EMBODIMENTS

Hereinafter, embodiments of the present disclosure will be described with reference to the accompanying drawings.

The following embodiments are embodied examples of the present disclosure and are not intended to limit the technical scope of the present disclosure.

First Embodiment

[1] Overall Configuration

First, the overall configuration of a ship 10 according to this embodiment will be described with reference to FIGS. 1 and 2.

The ship 10 is a moving body that sails (navigates) on water such as oceans, lakes, or rivers. In this embodiment, as an example, the ship 10 is a "pleasure boat," which is a small ship used primarily for sports or recreation. Further, in this embodiment, the ship 10 is configured to operate in response to operations (including remote control) by a person (navigator), and in particular, is a manned type that can be boarded by a person who is the navigator.

Figure 1:
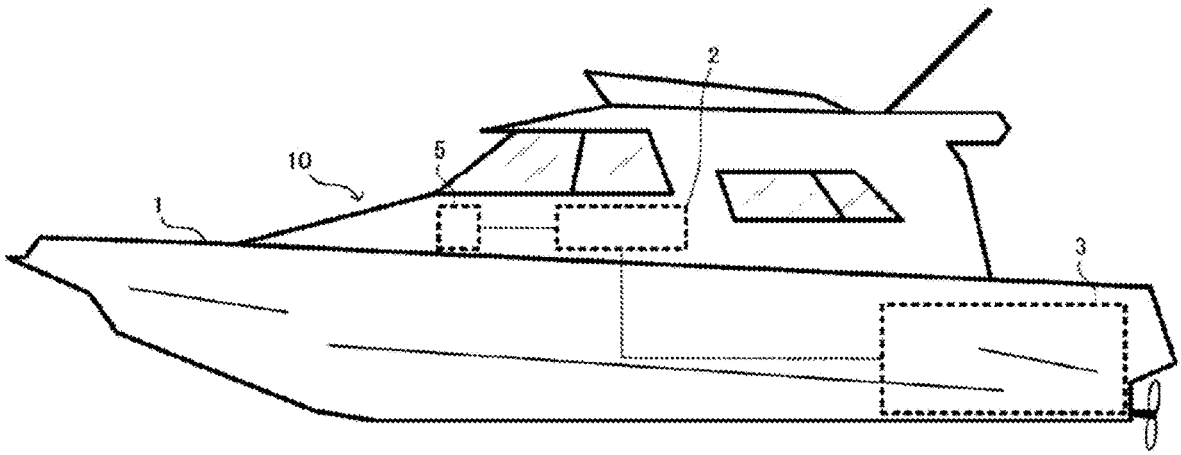
FIG. 1 is an external view illustrating a schematic configuration of a ship according to a first embodiment.

The ship 10 includes a hull 1 and a ship control system 2, as illustrated in FIG. 1. The hull 1 includes a drive unit 3 that generates power, an output section 4 that outputs a propulsive force for propelling the hull 1, and an operation device 5 that accepts operations by a person (navigator). In addition to this, the hull 1 further includes various onboard facilities and other equipment, including rudder mechanisms, display devices, communication devices, and lighting equipment.

Figure 2:
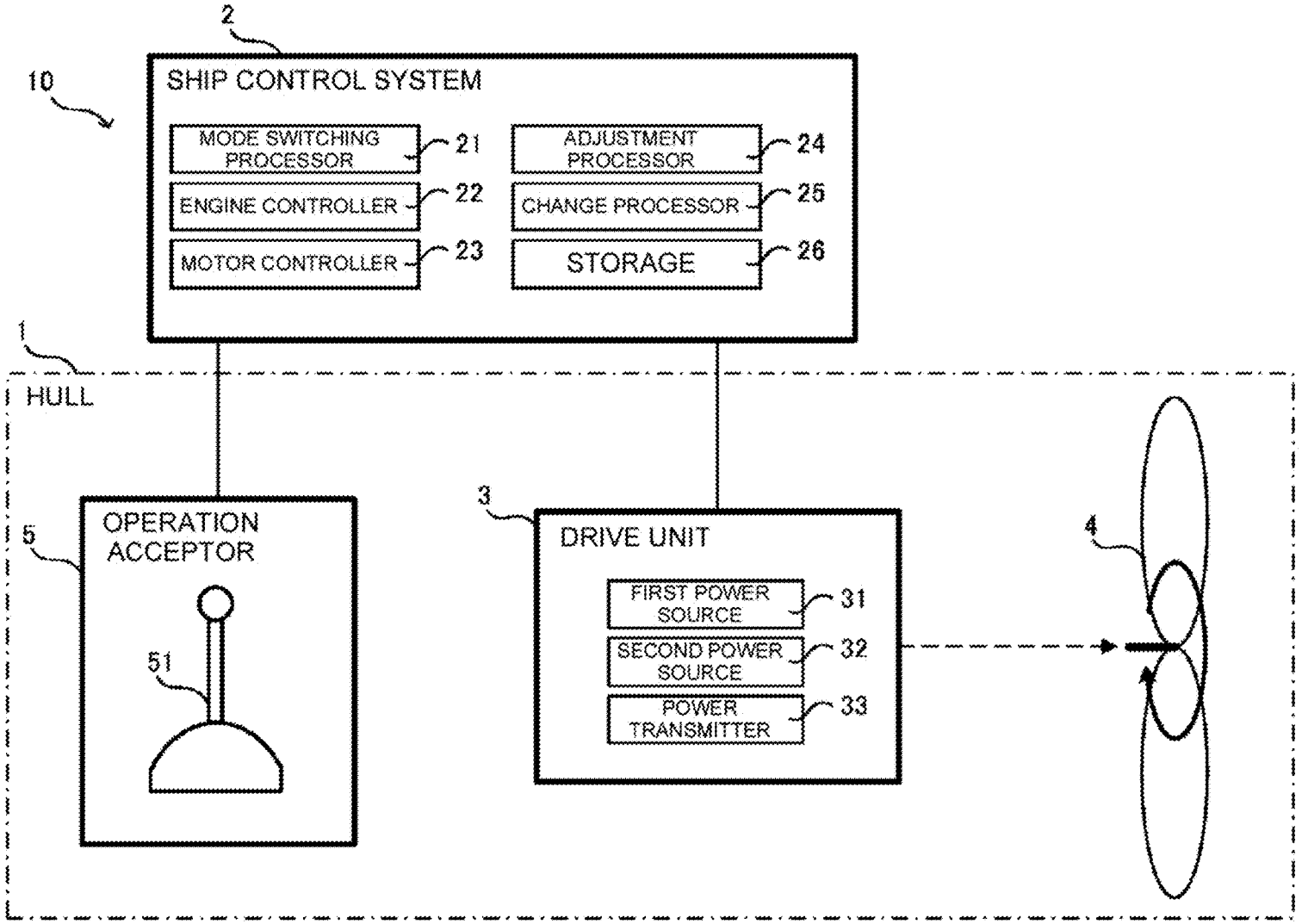
FIG. 2 is a block diagram illustrating a schematic configuration of the ship according to the first embodiment.

The drive unit 3, as illustrated in FIG. 2, has a plurality of power sources 31 and 32, and a power transmitter 33. In this embodiment, the output section 4 includes a propeller, and receives power generated by the drive unit 3 to rotate the propeller about a rotation shaft (propeller shaft), thereby outputting the propulsive force to move the hull 1 forward or backward.

The plurality of power sources 31 and 32 include at least a first power source 31 and a second power source 32, each of which generates power (mechanical energy) used to propel the hull 1. These plurality of power sources 31 and 32 have different output characteristics from each other, and the first power source 31 and the second power source 32 also differ at least in maximum output (maximum rpm and maximum torque). In this embodiment, the first power source 31 and the second power source 32 are different power sources that are completely different in method, type, and the like. In short, the ship 10 in this embodiment includes a hybrid drive unit 3 with multiple kinds of power sources 31 and 32.

In this embodiment, as an example, the first power source 31 is an engine (internal combustion engine) that generates power by burning fuel, and the second power source 32 is a motor (electric motor) that receives electrical power (electrical energy) to generate power. More particularly, the first power source 31 is a diesel engine driven by diesel fuel, and the second power source 32 is an AC motor driven by AC power.

The first power source 31 and the second power source 32 are driven separately and generate power respectively. Therefore, in the plurality of power sources 31 and 32, for example, the state where only the first power source 31 of the first power source 31 and the second power source 32 is driven, the state where only the second power source 32 is driven, the state where both the first power source 31 and the second power source 32 are driven can be switched. Here, the power generated by the first power source 31 and the power generated by the second power source 32 are combined at the power transmitter 33, and the combined power is supplied to the output section 4. Therefore, for example, by combining the power of the second power source 32 including a motor with the power of the first power source 31 including an engine, the second power source 32 can assist the first power source 31 and it is possible to drive the output section 4 with a larger power.

The power transmitter 33 is provided between the plurality of power sources 31 and 32 and the output section 4. The power transmitter 33 has a function of inputting power generated by the plurality of power sources 31 and 32 and transmitting this power to the output section 4. Here, the power transmitter 33 combines the power from the plurality of power sources 31 and 32 and outputs the combined power to the output section 4.

Furthermore, the power transmitter 33 has a function of switching whether to transmit the power from each of the plurality of power sources 31 and 32 to the output section 4, that is, switching between a "transmission state" and a "disconnected state". The "transmission state" in the present disclosure is the state where each power source 31 and 32 is mechanically connected to the output section 4 and power is transmitted from each power source 31 and 32 to the output section 4. When the power transmitter 33 is in the transmission state, each power source 31 and 32 is driven, and the output section 4 is driven by the power generated by each power source 31 and 32. The "disconnected state" in the present disclosure is the state where each power source 31 and 32 is mechanically disconnected to the output section 4 and power is not transmitted from each power source 31 and 32 to the output section 4. When the power transmitter 33 is in the disconnected state, even if each power source 31 and 32 is driven, the power generated by each power source 31 and 32 is not transmitted to the output section 4, and thus the output section 4 is not driven.

The drive unit 3 will be described in detail in the section of "[2] Configuration of Drive Unit".

The output value related to the propulsive force of the hull 1 generated by the output section 4 varies in accordance with the power transmitted from the drive unit 3 to the output section 4. The "output value" in the present disclosure may be any value related to the propulsive force of the hull 1, such as the rpm (rotation speed) of the propeller in the output section 4 or the speed of the hull 1 (ship speed). In this embodiment, as an example, the "output value" is the rpm of the propeller in the output section 4. That is, basically, the greater the power output from the drive unit 3, the greater (higher speed rotation) the output value (the rpm of the propeller).

The ship control system 2 is mainly configured by a computer system including one or more processors, such as a CPU (Central Processing Unit) and at least one memory, such as a ROM (Read Only Memory) or a RAM (Random Access Memory) and executes various processing (information processing). A program (ship control program) for causing one or more processors to execute a control method of the ship 10 is recorded in one or more memories in the ship control system 2.

The ship control system 2 controls at least the drive unit 3. That is, the ship control system 2 controls, for example, the driving status of each of the first power source 31 and the second power source 32, and the state (transmission state/disconnected state, etc.) of the power transmitter 33.

In this embodiment, the ship control system 2 is electrically connected to the operation device 5, and controls the drive unit 3 or the like in response to an operation signal from the operation device 5. For example, the ship control system 2 controls the drive unit 3 in response to an operation signal from the operation device 5 to rotate the propeller of the output section 4, and it is thereby possible to make the hull 1 to move forward or backward.

Furthermore, the ship control system 2 controls the output (rpm or torque) of the first power source 31 or the second power source 32, and it is thereby possible to adjust the rpm of the propeller of the output section 4 and thus the moving speed (ship speed) of the hull 1.

Further, the ship control system 2 can also switch among a plurality of propulsion modes. The "propulsion mode" in the present disclosure is a mode in which, a power source 31, 32 used for propulsion of a hull 1 is different between the plurality of the power sources 31 and 32. That is, the ship control system 2 can switch among a plurality of propulsion modes by switching which of the plurality of power sources 31 and 32 is used for propulsion of the hull 1.

In this embodiment, as an example, the plurality of propulsion modes include three propulsion modes, hybrid propulsion mode, motor propulsion mode, and engine propulsion mode. The hybrid propulsion mode is a propulsion mode in which both the first power source 31 (engine) and the second power source 32 (motor) are used for propulsion of the hull 1. The motor propulsion mode is a propulsion mode in which only the second power source 32 (motor) of the first power source 31 and the second power source 32 is used for propulsion of the hull 1. The engine propulsion mode is a propulsion mode in which only the first power source 31 (engine) of the first power source 31 and the second power source 32 is used for propulsion of the hull 1.

In this embodiment, the ship control system 2 is an integrated controller that controls the entire hull 1 and is configured by, for example, an electronic control unit (ECU: Electronic Control Unit). However, the ship control system 2 may be provided separately from the integrated controller. The ship control system 2 will be described in detail in the section of "[3] Configuration of Ship Control System".

The operation device 5 is a user interface that accepts the operation of a person (navigator), and is disposed in a control cabin where the navigator of the hull 1 is boarded, as an example. The operation device 5, for example, accepts various operations by the navigator and outputs electrical signals (operation signals) to the ship control system 2 according to the operations. In this embodiment, as an example, the operation device 5 includes an operation acceptor 51 (see FIG. 2) which includes a rotatable operating lever. The operation device 5 includes a detector such as an encoder that detects the position (angle of rotation) of the operation acceptor 51, and detects the operation amount of the operation acceptor 51 from the position of the operation acceptor 51, and outputs an operation signal indicating the operation amount. Further, the operation device 5 may further include a plurality of mechanical switches, a touch panel, an operating dial, and the like.

A display device, a communication device, and the like are also disposed in the control cabin. The display device is a user interface for outputting various information to a person (navigator). The display device is, for example, electrically connected to the ship control system 2 and displays various screens in accordance with a display control signal from the ship control system 2. The communication device is configured to be able to communicate with another system (including a server) outside the hull 1, and data can be exchanged with another system.

[2] Configuration of Drive Unit

Next, the configuration of the drive unit 3 will be described in more detail with reference to FIGS. 3 to 5B.

Figure 3:
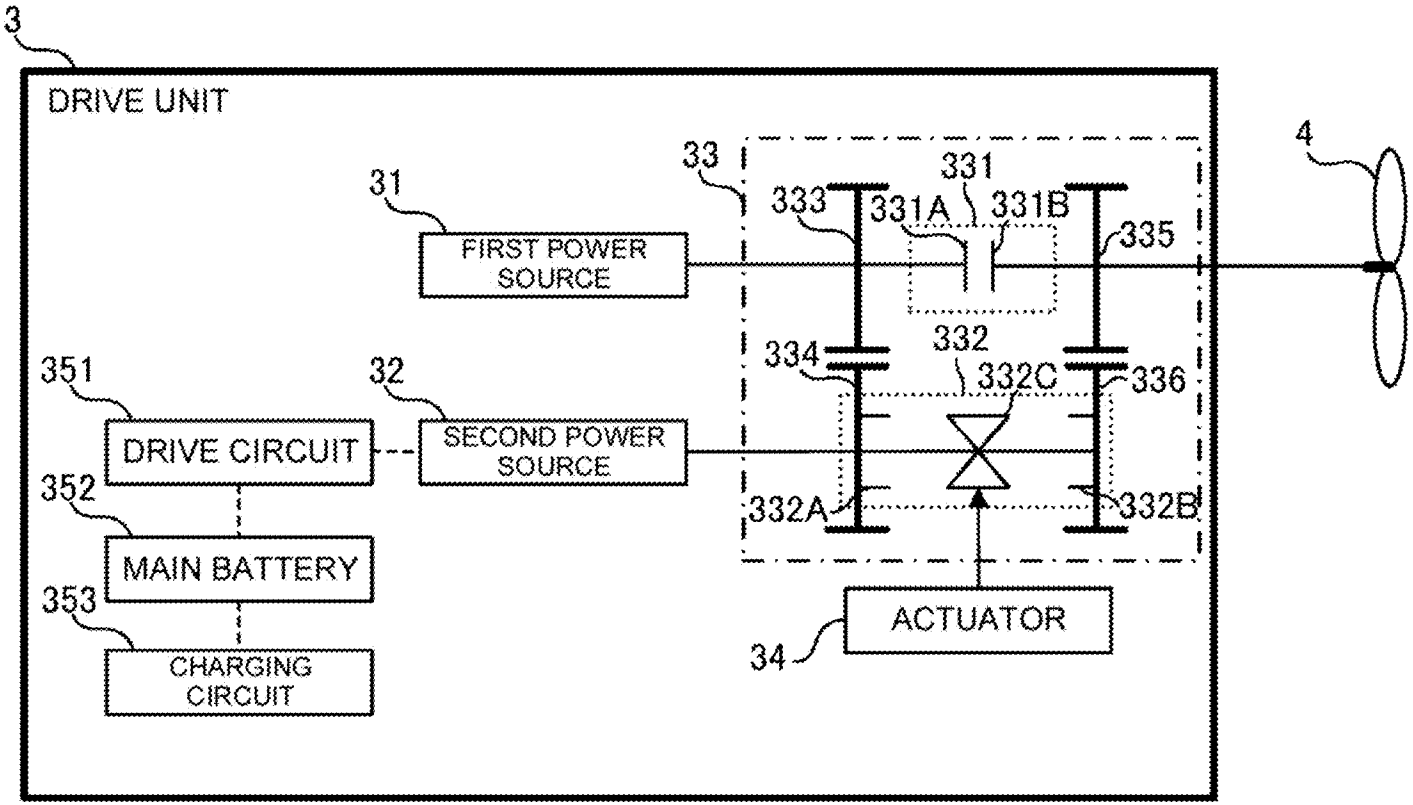
FIG. 3 is a schematic diagram of the drive unit of the ship according to the first embodiment.

The drive unit 3, as described above, has the plurality of power sources 31 and 32 (a first power source 31 and a second power source 32), and the power transmitter 33. Further, as illustrated in FIG. 3, the drive unit 3 further includes an actuator 34, a drive circuit 351, a main battery 352, a charging circuit 353, and the like. In FIG. 3 and other figures, electrical connections, such as between the drive circuit 351 and the main battery 352, are indicated by dashed lines.

In this embodiment, the first power source 31 is a diesel engine, has a combustion chamber divided by a cylinder or the like, and the combustion of fuel (light oil) in the combustion chamber causes a reciprocating piston movement. The first power source 31 is provided with a crankshaft that revolves in response to the reciprocating movement of the piston as an output shaft, and the crankshaft is connected to the power transmitter 33. As a result, power from the first power source 31 is input to the power transmitter 33 through the crankshaft.

In this embodiment, the second power source 32 is an AC motor, which is driven by AC power (AC voltage) supplied from the drive circuit 351 including an inverter circuit. The drive circuit 351 is electrically connected to the main battery 352, and converts the DC voltage output from the main battery 352 into an AC voltage and supplies the AC voltage to the second power source 32 to thereby drive the second power source 32. The output shaft of the second power source 32 is connected to the power transmitter 33, and power from the second power source 32 is input to the power transmitter 33 through the output shaft. The main battery 352 is provided separately from an auxiliary battery and includes a large-capacity secondary battery (storage battery), such as a lithium-ion battery, as an example. The charging circuit 353 is electrically connected to the main battery 352 and charges the main battery 352 with the use of output power of, for example, a land power source (power system) or an alternator or the like.

Furthermore, in this embodiment, the drive circuit 351 is a bidirectional inverter circuit, which has a function of not only converting a DC voltage to an AC voltage, but also converting an AC voltage to a DC voltage. Therefore, the drive circuit 351 not only can convert the DC voltage output from the main battery 352 to an AC voltage and output the AC voltage to the second power source 32, but also can convert the AC voltage output from the second power source 32 to a DC voltage and output the DC voltage to the main battery 352. That is, in the drive unit 3 according to this embodiment, by using the second power source 32 as a generator, the electrical energy (AC power) generated when the second power source 32 is revolved by an external force can be used to charge the main battery 352 by the drive circuit 351.

In this embodiment, as illustrated in FIG. 3, the power transmitter 33 includes a first clutch 331, a second clutch 332, a first gear 333, a second gear 334, a third gear 335, and a fourth gear 336. In FIG. 3 and other figures, the configuration of the power transmitter 33 is simplified, but the first gear 333, second gear 334, third gear 335, and fourth gear 336, and the like are included in the reduction device as marine gears.

The first clutch 331 is inserted between the output shaft (crankshaft) of the first power source 31 and the output section 4. That is, the first clutch 331 is located in the middle of the power transmission path from the first power source 31 to the output section 4. The first clutch 331 has an input side revolving body 331A and an output side revolving body 331B, and is configured to be able to switch between a state where the input side revolving body 331A and the output side revolving body 331B are connected (transmission state) and a state where the input side revolving body 331A and the output side revolving body 331B are disconnected (disconnected state).

The input side revolving body 331A is connected to the output shaft (crankshaft) of the first power source 31, and the output side revolving body 331B is connected to the output section 4. As a result, the input side revolving body 331A revolves under the power generated by the first power source 31. Further, if the first clutch 331 is in the transmission state, the power of the first power source 31 is transmitted to the output section 4 via the first clutch 331. If the first clutch 331 is in the disconnected state, the power of the first power source 31 is disconnected by the first clutch 331 and is not transmitted to the output section 4.

As an example, the first clutch 331 includes a hydraulic clutch such as a wet multi-plate clutch, and the hydraulic oil is supplied from a hydraulic circuit including a hydraulic pump, and switching between the transmission state and disconnected state is performed. The switching between the transmission state and the disconnected state of the first clutch 331 is performed, for example, by controlling the solenoid valve of the hydraulic circuit with the ship control system 2. That is, the ship control system 2 directly or indirectly controls the first clutch 331 to switch the first clutch 331 between the transmission state and the disconnected state.

The first gear 333 is connected to the input side revolving body 331A of the first clutch 331, and rotates with the revolution of the input side revolving body 331A. The second gear 334 is provided to mesh with the first gear 333 and rotates with the first gear 333. The third gear 335 is connected to the output side revolving body 331B of the first clutch 331, and rotates with the revolution of the output side revolving body 331B. The fourth gear 336 is provided to mesh with the third gear 335 and rotates with the third gear 335.

The second clutch 332 is inserted between the output shaft of the second power source 32 and the second gear 334 and the fourth gear 336. That is, the second clutch 332 is located in the middle of the power transmission path from the second power source 32 to the output section 4. The second clutch 332 has a motor side revolving body 332C and an other side revolving body 332A, and is configured to be able to switch between a state where the motor side revolving body 332C and the other side revolving bodies 332A and 332B are connected (transmission state) and a state where the motor side revolving body 332C and the other side revolving bodies 332A and 332B are disconnected (disconnected state).

In this embodiment, as the other side revolving bodies 332A and 332B, a first other side revolving body 332A and a second other side revolving body 332B are provided. The second clutch 332 can switch among a first transmission state where the motor side revolving body 332C is connected to the first other side revolving body 332A, a second transmission state where the motor side revolving body 332C is connected to the second other side revolving body 332B, and a disconnected state where the motor side revolving body 332C is separated from both the first other side revolving body 332A and the second other side revolving body 332B.

The motor side revolving body 332C is connected to the output shaft of the second power source 32. The first other side revolving body 332A is connected to the second gear 334, and the second other side revolving body 332B is connected to the fourth gear 336. As a result, the motor side revolving body 332C revolves under the power generated by the second power source 32. Further, if the second clutch 332 is in the first transmission state, the power of the second power source 32 is transmitted to the input side revolving body 331A of the first clutch 331 via the second clutch 332, the second gear 334, and the first gear 333. At this time, if the first clutch 331 is in the transmission state, the power of the second power source 32 is combined with the power of the first power source 31 and transmitted to the output section 4 via the first clutch 331. Further, if the second clutch 332 is in the second transmission state, the power of the second power source 32 is transmitted to the output section 4 via the second clutch 332, the fourth gear 336, and the third gear 335. On the other hand, if the second clutch 332 is in the disconnected state, the power of the second power source 32 is disconnected by the second clutch 332 and not transmitted to the output section 4.

The second clutch 332 includes a meshing clutch, such as a dog clutch, as an example. The switching among the first transmission state, the second transmission state, and the disconnected state of the second clutch 332 is performed by moving the motor side revolving body 332C by the actuator 34 including a shifter. The actuator 34 moves the motor side revolving body 332C to a position for fitting into the first other side revolving body 332A, thereby putting the second clutch 332 into the first transmission state where the motor side revolving body 332C and the first other side revolving body 332A mesh with each other. Further, the actuator 34 moves the motor side revolving body 332C to a position for fitting into the second other side revolving body 332B, thereby putting the second clutch 332 into the second transmission state where the motor side revolving body 332C and the second other side revolving body 332B mesh with each other. The actuator 34 moves the motor side revolving body 332C to a position for not fitting into either the first other side revolving body 332A or the second other side revolving body 332B, thereby putting the second clutch 332 into the disconnected state.

The switching among the first transmission state, the second transmission state, and the disconnected state of the second clutch 332 is performed, for example, by controlling the electric actuator 34 with the ship control system 2. That is, the ship control system 2 directly or indirectly controls the second clutch 332 to switch the second clutch 332 between the transmission state (first transmission state or second transmission state) and the disconnected state.

According to the drive unit 3 configured as described above, the ship control system 2 can control the first clutch 331 and the second clutch 332, thereby enabling switching among the plurality of propulsion modes as illustrated in FIGS. 4A to 5B. In FIGS. 4A to 5B, the state of drive unit 3 in each propulsion mode is schematically indicated, and the drive circuit 351, main battery 352 and charging circuit 353 are omitted. Further, in FIGS. 4A to 5B, the power transmitted from the power sources 31 and 32 to the output section 4 is indicated by a (bold) dashed arrow.

Figure 4A:
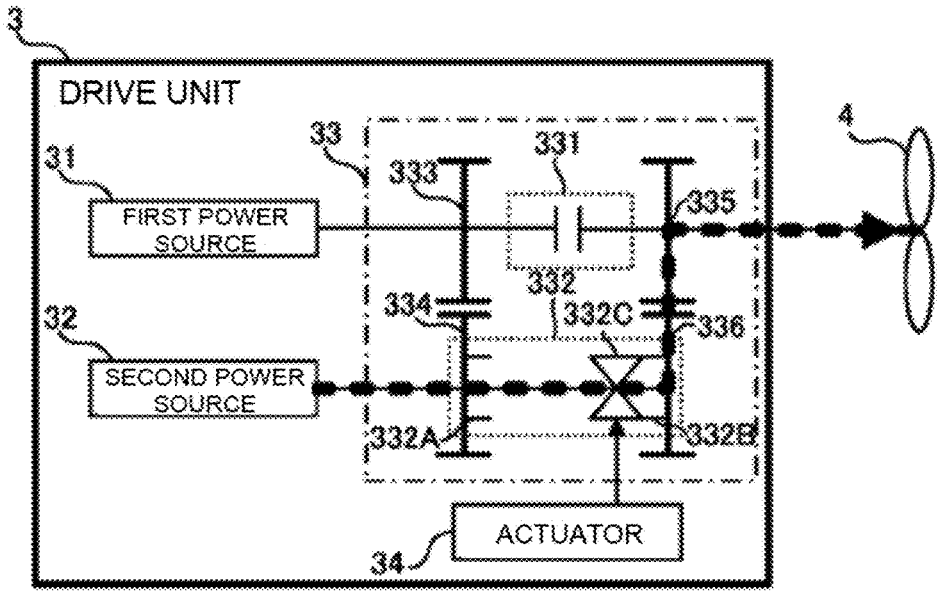
FIGS. 4A and 4B are schematic diagrams of the state of the drive unit in the motor propulsion mode and engine propulsion mode of the ship according to the first embodiment.

FIG. 4A illustrates the motor propulsion mode in which only the second power source 32 (motor) of the first power source 31 and the second power source 32 is used for propulsion of the hull 1. In the motor propulsion mode, the ship control system 2 controls the first clutch 331 to be in the disconnected state and the second clutch 332 to be in the second transmission state. Furthermore, in the motor propulsion mode, the ship control system 2 controls the drive circuit 351 so as to stop the first power source 31 and drive the second power source 32 with the electric power from the main battery 352. As a result, as illustrated in FIG. 4A, the power generated by the second power source 32 is transmitted to the output section 4 via the second clutch 332, the fourth gear 336, and the third gear 335, and the propeller of the output section 4 can be rotated to generate the propulsive force of the hull 1.

Figure 4B:
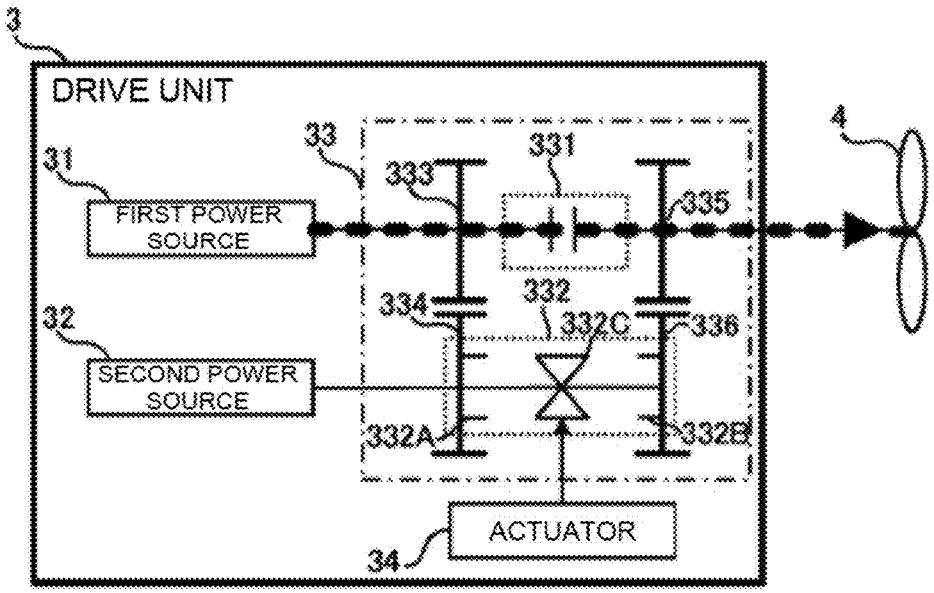

FIG. 4B illustrates the engine propulsion mode in which only the first power source 31 (engine) of the first power source 31 and the second power source 32 is used for propulsion of the hull 1. In the engine propulsion mode, the ship control system 2 controls the first clutch 331 to be in the transmission state and the second clutch 332 to be in the disconnected state. Furthermore, in the engine propulsion mode, the ship control system 2 controls the drive circuit 351 so as to drive the first power source 31 and stop the second power source 32. As a result, as illustrated in FIG. 4B, the power generated by the first power source 31 is transmitted to the output section 4 via the first clutch 331, and the propeller of the output section 4 can be rotated to generate the propulsive force of the hull 1.

Figure 5A:
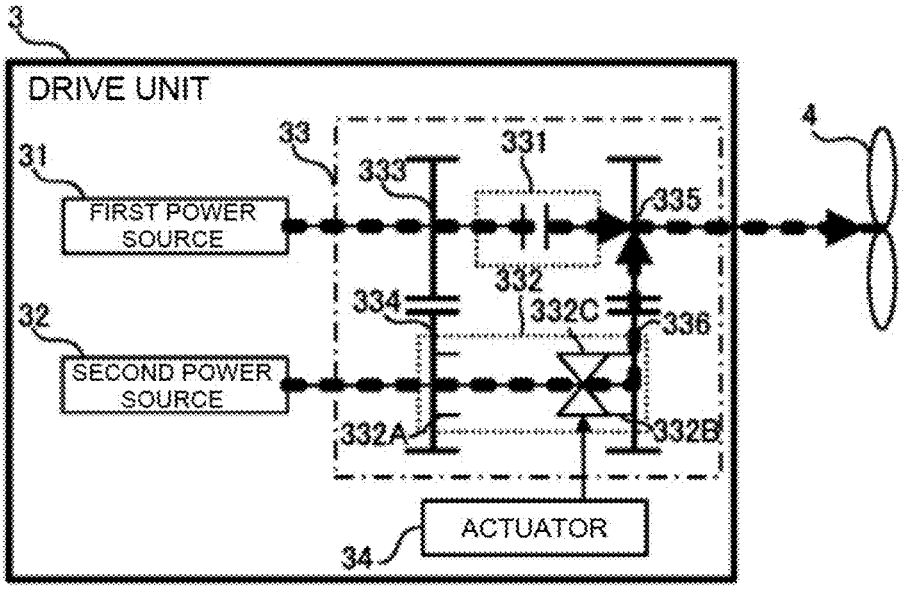
FIGS. 5A and 5B are schematic diagrams illustrating the state of the drive unit in the hybrid propulsion mode of the ship according to the first embodiment.

FIG. 5A illustrates a "hybrid propulsion mode (low speed)" suitable for navigation at "low speed", of the hybrid propulsion modes in which both the first power source 31 (engine) and the second power source 32 (motor) are used for propulsion of the hull 1. In this hybrid propulsion mode (low speed), the ship control system 2 controls the first clutch 331 to be in the transmission state and the second clutch 332 to be in the second transmission state. Furthermore, in the hybrid propulsion mode (low speed), the ship control system 2 controls the drive circuit 351 so as to drive the first power source 31 and drive the second power source 32 with the electric power from the main battery 352. As a result, as illustrated in FIG. 5A, the power generated by the first power source 31 is transmitted to the output section 4 via the first clutch 331, and the power generated by the second power source 32 is transmitted to the output section 4 via the second clutch 332, the fourth gear 336, and the third gear 335. Consequently, the power from the first power source 31 and the power from the second power source 32 are combined, and the propeller of the output section 4 is rotated to generate the propulsive force of the hull 1.

Figure 5B:
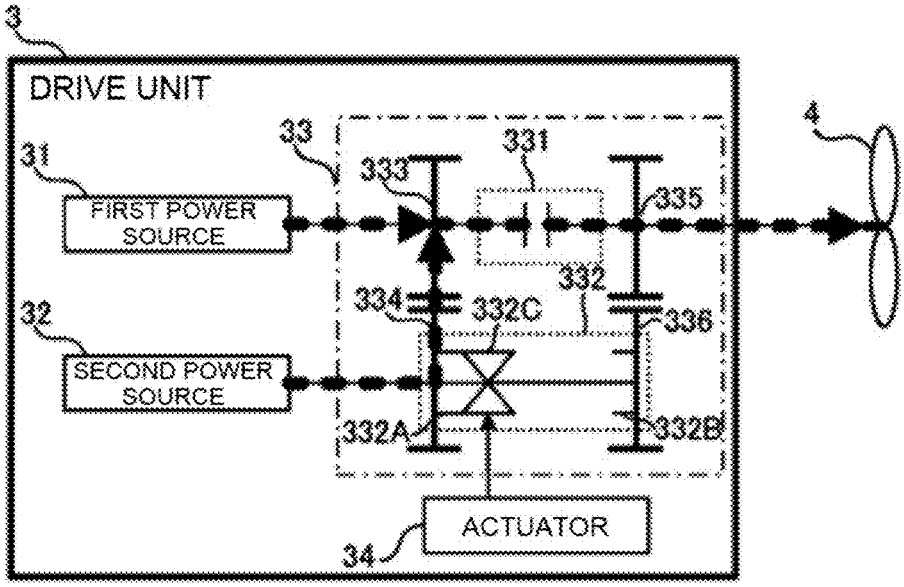

FIG. 5B illustrates a "hybrid propulsion mode (high speed)" suitable for navigation at "high speed", of the hybrid propulsion modes in which both the first power source 31 (engine) and the second power source 32 (motor) are used for propulsion of the hull 1. In this hybrid propulsion mode (high speed), the ship control system 2 controls the first clutch 331 to be in the transmission state and the second clutch 332 to be in the first transmission state. Furthermore, in the hybrid propulsion mode (high speed), the ship control system 2 controls the drive circuit 351 so as to drive the first power source 31 and drive the second power source 32 with the electric power from the main battery 352. As a result, as illustrated in FIG. 5B, the power generated by the first power source 31 is transmitted to the output section 4 via the first clutch 331, and the power generated by the second power source 32 is transmitted to the output section 4 via the second clutch 332, the second gear 334, the first gear 333, and the first clutch 331. Consequently, the power from the first power source 31 and the power from the second power source 32 are combined, and the propeller of the output section 4 is rotated to generate the propulsive force of the hull 1.

Further, in the motor propulsion mode illustrated in FIG. 4A, when the hull 1 sails, it is possible to charge the main battery 352 by supplying the rotational force of the propeller of the output section 4 to the main battery 352 as regenerative energy (charging mode). In this case, the rotational force of the output section 4 is transmitted to the second power source 32 via the third gear 335, the fourth gear 336, and the second clutch 332, and revolves the output shaft of the second power source 32, and AC power is thereby generated in the second power source 32. The AC power generated by the second power source 32 is used for charging the main battery 352 by the drive circuit 351 including a bidirectional inverter circuit.

Similarly, in the hybrid propulsion mode (high speed) illustrated in FIG. 5B, when the hull 1 sails or stops (is anchored), it is also possible to charge the main battery 352 by using the power generated by the first power source 31 (charging mode). In this case, the ship control system 2 controls the first clutch 331 to be in the disconnected state, whereby the power generated by the first power source 31 is transmitted to the second power source 32 via the first gear 333, the second gear 334, and the second clutch 332, and revolves the output shaft of the second power source 32, and AC power is thereby generated in the second power source 32. The AC power generated by the second power source 32 is used for charging the main battery 352 by the drive circuit 351 including a bidirectional inverter circuit.

Furthermore, although omitted in FIG. 3 and other figures, the drive unit 3 further has a hydraulic circuit for driving the first clutch 331, and various sensors and the like.

[3] Configuration of Ship Control System

Next, the configuration of the ship control system 2 according to this embodiment will be described with reference to FIGS. 2 and 6A to 6C. The ship control system 2 is a component of the ship 10 and constitutes the ship 10 with the hull 1. In other words, the ship 10 includes the ship control system 2 and the hull 1. In this embodiment, as an example, the ship control system 2 is a computer system mounted on the hull 1.

As illustrated in FIG. 2, the ship control system 2 includes a mode switching processor 21, an engine controller 22, a motor controller 23, and an adjustment processor (engine rpm processor and/or motor rpm processor) 24, a change processor (motor torque processor) 25, and a storage 26. In this embodiment, as an example, the ship control system 2 is mainly composed of a computer system having one or more processors, and thus these plurality of functional parts (mode switching processor 21, etc.) are implemented by executing the ship control program by one or more processors. The plurality of functional parts in the ship control system 2 may be distributed to a plurality of housings or may be included in one housing.

The ship control system 2 can communicate with devices included in the various parts of the hull 1. That is, at least the operation device 5, the first power source 31, the drive circuit 351 that drives the second power source 32, the solenoid valve for controlling the first clutch 331, the actuator 34 for controlling the second clutch 332, and the like are communicatively connected to the ship control system 2. This allows the ship control system 2 to control the drive unit 3, for example, in response to an operation signal from the operation device 5. Here, the ship control system 2 may transmit and receive various types of information (electrical signal) directly to and from each device, or indirectly through a repeater or the like.

The mode switching processor 21 executes the processing of switching the propulsion mode of the ship 10. In this embodiment, the ship 10 has the plurality of propulsion modes, including the hybrid propulsion mode, motor propulsion mode, and engine propulsion mode, as described above. In this embodiment, the mode switching processor 21 selects any of the hybrid propulsion mode, motor propulsion mode, or engine propulsion mode in accordance with the operation of a person (navigator) to the operation device 5. As an example, the operation device 5 has a mode selection switch, and when any of the hybrid propulsion mode, motor propulsion mode, or engine propulsion mode is selected with the mode selection switch, the mode is switched to that propulsion mode. In short, in this embodiment, the switching of the propulsion mode is performed in response to a switching operation by the user.

Specifically, the mode switching processor 21 controls the drive unit 3 to operate in the selected propulsion mode. For example, the mode switching processor 21 controls the first clutch 331 to be in the disconnected state and the second clutch 332 to be in the second transmission state, thereby switching the propulsion mode of the ship 10 to the motor propulsion mode (see FIG. 4A). Further, the mode switching processor 21 controls the first clutch 331 to be in the transmission state and the second clutch 332 to be in the second disconnected state, thereby switching the propulsion mode of the ship 10 to the engine propulsion mode (see FIG. 4B). The propulsion mode switched by the mode switching processor 21, i.e., the currently selected propulsion mode, should be presented to a person (navigator), for example, on a display device.

The engine controller 22 controls the first power source 31 which includes an engine. Specifically, the engine controller 22 controls fuel injection to drive the first power source 31, as well as exhaust valve opening and closing. Thereby, the engine controller 22 can control the first power source 31 so as to adjust the output (mainly the rpm) of the first power source 31 to a given value.

The motor controller 23 controls the second power source 32 which includes a motor. Specifically, the motor controller 23 controls the drive circuit 351 or the like to drive the second power source 32. Thereby, the motor controller 23 can control the second power source 32 so as to adjust the output (mainly the rpm) of the second power source 32 to a given value. In this embodiment, in particular, the motor controller 23 can perform two types of control, an rpm control (revolution speed control) and a torque control, as the control of the second power source 32 (motor). In the rpm control, the motor controller 23 sets a target rpm of the second power source 32 (motor), and controls the rpm of the second power source 32 (motor) so as to approach the target rpm. In the torque control, the motor controller 23 sets a target torque of the second power source 32 (motor), and controls the torque of the second power source 32 (motor) so as to approach the target torque.

The adjustment processor 24 adjusts the output value related to the propulsive force of the hull 1 to a value corresponding to the operation amount of the operation acceptor 51. In this embodiment, since the "output value" is the number of rotations of the propeller of the output section 4, the adjustment processor 24 adjusts the rpm of the propeller to a value corresponding to the operation amount of the operation acceptor 51. Basically, the adjustment processor 24 increases the output value related to the propulsive force of the hull 1 as the operation amount of the operation acceptor 51 is larger, and decreases the output value related to the propulsive force of the hull 1 as the operation amount of the operation acceptor 51 is smaller. When an operation signal indicating the operation amount of the operation acceptor 51 is input from the operation device 5, the adjustment processor 24 determines the output value corresponding to this operation amount. Then, the adjustment processor 24 controls the first power source 31 and the second power source 32 by the engine controller 22 and the motor controller 23 in such a manner that the propulsive force corresponding to the output value is generated in the output section 4.

Figure 6A:
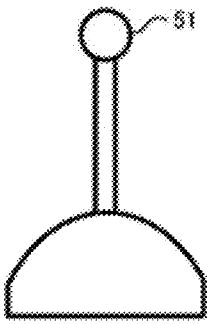
FIGS. 6A to 6C are each a schematic diagram illustrating the operation amount of the operation acceptor of the ship according to the first embodiment.
Figure 6B:
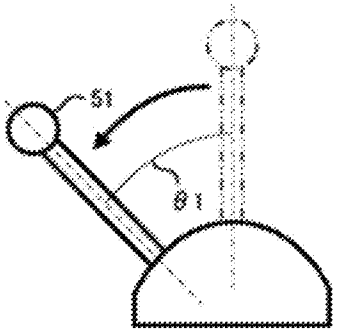
Figure 6C:
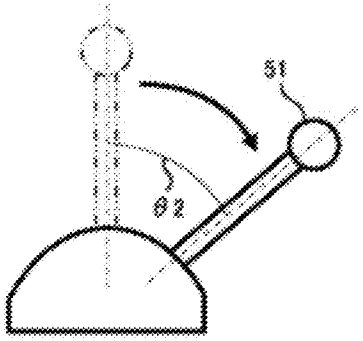

Here, the operation amount of the operation acceptor 51 corresponds to the angle of rotation of the operation acceptor 51 including an operating lever. More specifically, as illustrated in FIGS. 6A to 6C, in a state where the operation acceptor 51 can rotate (move) from the neutral position to each of the forward position and the backward position and the operation acceptor 51 is at the neutral position, the propulsive force of the hull 1 is 0 (zero). In this case, in order to move the hull 1 forward, the navigator rotates (moves) the operation acceptor 51 from the neutral position to the forward position side, and in order to move the hull 1 backward, the navigator rotates (moves) the operation acceptor 51 from the neutral position to the backward position side. Further, a rotation angle θ1 of the operation acceptor 51 from the neutral position to the forward position side is the operation amount of the operation acceptor 51 when the hull 1 is moved forward, and a rotation angle θ2 of the operation acceptor 51 from the neutral position to the backward position is the operation amount of the operation acceptor 51 when the hull 1 is moved backward. Therefore, the adjustment processor 24 increases the output value (the rpm of the propeller) for moving the hull 1 forward as the rotation angle θ1 of the operation acceptor 51 from the neutral position to the forward position side is larger.

Here, the correspondence relation between the operation amount of the operation acceptor 51 and the output value related to the propulsive force of the hull 1 is predetermined as "allocation data. The allocation data is data that defines the allocation (assignment) of output values (the rpm of the propeller) with respect to the operation amount of the operation acceptor 51. The allocation data may define the correspondence relation between the operation amount of the operation acceptor 51 and the output value, and may be, for example, table data in which the output value is individually associated with each value of the operation amount of the operation acceptor 51, and may be function data for calculating an output value corresponding to the operation amount of the operation acceptor 51. The allocation data is stored, for example, in the storage 26, and the adjustment processor 24 identifies the output value with respect to the operation amount of the operation acceptor 51 by referring to the allocation data.

The change processor 25 changes the correspondence relation between the operation amount and the output value in accordance with the propulsion mode. More specifically, the correspondence relation between the operation amount and the output value used when the adjustment processor 24 adjusts the output value (the rpm of the propeller) to the value corresponding to the operation amount of the operation acceptor 51 as described above is not fixed and changed in accordance with the propulsion mode. In this embodiment, a plurality of pieces of allocation data are stored in the storage 26 to correspond to the plurality of propulsion modes one-on-one, and the change processor 25 changes which of these plurality of pieces of allocation data is used by the adjustment processor 24, in accordance with the propulsion mode.

As an example, it is assumed that the operation amount of the operation acceptor 51 changes in 100 steps from "0" to "99" for each of forward movement and backward movement. In this case, if the ship 10 is in the motor propulsion mode, the output value (rpm of the propeller) when the operation acceptor 51 is operated to the forward position side by an operation amount "40" is "50 rpm", and similarly, the output value when the operation acceptor 51 is operated to the forward position side by an operation amount "80" is "100 rpm". Meanwhile, if the ship 10 is in the engine propulsion mode, the output value (rpm of the propeller) when the operation acceptor 51 is operated to the forward position side by an operation amount "40" is "80 rpm", and similarly, the output value when the operation acceptor 51 is operated to the forward position side by an operation amount "80" is "160 rpm".

Two types of control, an rpm control (revolution speed control) and a torque control are possible for only the second power source 32 (motor), of the first power source 31 (engine) and the second power second power source 32 (motor). That is, the engine controller 22 does not support two types of control, the rpm control (revolution speed control) and the torque control, as the motor controller 23 does.

When the motor propulsion mode is switched to the hybrid propulsion mode, before the clutch (first clutch 331) is switched from the disconnected state to the transmission state, the engine rpm processor 24 synchronizes the rpm of the engine (first power source 31) with the rpm of the motor (second power source 32). Here, the first clutch 331 is a friction clutch, such as a hydraulic clutch, and is provided between the engine (first power source 31) and the output section 4 that outputs the propulsive force of the hull 1. The "other device" referred to here includes at least one of the output section 4 that generates the propulsive force of the hull 1 and the engine (first power source 31). That is, when the motor propulsion mode in which only the motor (second power source 32) is used for propulsion of the hull 1 is switched to the hybrid propulsion mode in which both the engine (first power source 31) and the motor (second power source 32) are used for propulsion of the hull 1, the engine rpm processor 24 controls the rpm of the first power source 31 (engine) by the engine controller 22 so as to synchronize the rpm of the engine (first power source 31) with the rpm of the motor (second power source 32). In this embodiment, as an example, when the rpm of the input side revolving body 331A and the rpm of the output side revolving body 331B in the first clutch 331 substantially match, the rpm of the engine (first power source 31) is synchronized with the rpm of the motor (second power source 32).

In short, when the motor propulsion mode is switched to the hybrid propulsion mode, in a state where the rpm of the engine (first power source 31) is synchronized with the rpm of the motor (second power source 32), the first clutch 331 is switched from the disconnected state to the transmission state. In doing so, in the first clutch 331, the rpm of the input side revolving body 331A connected to the engine (first power source 31) substantially matches the rpm of the output side revolving body 331B connected to the motor (second power source 32) via the third gear 335, the fourth gear 336, and the second clutch 332.

The motor torque processor 25 controls the torque of the motor (second power source 32) during the torque control period after the rpm is synchronized. More specifically, after the engine rpm processor 24 synchronizes the rpm of the engine (first power source 31) with the rpm of the motor (second power source 32), the motor torque processor 25 switches the control of the second power source 32 (motor) from the rpm control to the torque control during the torque control period after the rpm is synchronized. If the period during which the motor controller 23 controls the torque of the second power source 32 (motor) is defined as a "torque control period", the torque control period starts after the rpm of the engine (first power source 31) is synchronized with the rpm of the motor (second power source 32).

Before the motor side revolving body 332C on the motor (second power source 32) side and the other side revolving bodies 332A and 332B on the other device side in the second clutch 332 are fitted, the motor rpm processor 24 sets an rpm difference between the motor side revolving body 332C and the other side revolving bodies 332A and 332B by controlling the rpm of the motor (second power source 32). Here, the second clutch 332 is a meshing clutch, such as a dog clutch, and is provided between the other device and the motor (second power source 32). The "other device" referred to here includes at least one of the output section 4 that generates the propulsive force of the hull 1 and the engine (first power source 31). That is, when the meshing second clutch 332 is fitted, the motor rpm processor 24 controls the rpm of the second power source 32 (motor) by the motor controller 23 in such a manner that there is an rpm difference between the motor side revolving body 332C and the other side revolving bodies 332A and 332B.

In short, if the other device is the first power source 31, when the motor side revolving body 332C is fitted into the first other side revolving body 332A connected to the first power source 31, the second clutch 332 is put in a state where power can be transmitted between the second power source 32 and the other device (first transmission state). In this manner, when the second clutch 332 switches from the disconnected state to the first transmission state, the motor rpm processor 24 controls the rpm of the second power source 32 (motor) in such a manner that there is an rpm difference between the motor side revolving body 332C and the first other side revolving body 332A. Similarly, if the other device is the output section 4, when the motor side revolving body 332C is fitted into the second other side revolving body 332B connected to the output section 4, the second clutch 332 is put in a state where power can be transmitted between the second power source 32 and the other device (second transmission state). In this manner, when the second clutch 332 switches from the disconnected state to the second transmission state, the motor rpm processor 24 controls the rpm of the second power source 32 (motor) in such a manner that there is an rpm difference between the motor side revolving body 332C and the second other side revolving body 332B.

The storage 26 includes a non-volatile storage device such as an HDD (Hard Disk Drive) or an SSD (Solid State Drive), that stores various types of information. The storage 26 stores (memorizes) a control program such as a ship control program for causing the ship control system 2 to execute a ship control method. Furthermore, the allocation data and other data mentioned above are also stored in the storage 26.

[4] Ship Control Method

Hereinafter, an example of a control method (hereinafter, also simply referred to as "control method") of the ship 10 executed mainly by the ship control system 2 will be described with reference to FIGS. 7 to 11, FIGS. 13 to 19, and FIGS. 23A to 25.

The control method according to this embodiment is executed by the ship control system 2, which is mainly composed of a computer system, and thus, in other words, the control method is embodied in a ship control program. That is, the ship control program according to this embodiment is a computer program for causing one or more processors to execute each processing related to the control method of the ship 10. Such a ship control program may be cooperatively executed by, for example, the ship control system 2 and a terminal device.

Here, the ship control system 2 executes the following various kinds of processing related to the control method when a specific start operation, which is set in advance to execute the ship control program, is performed. The start operation is, for example, the power-on operation of the ship 10. Meanwhile, the ship control system 2 ends the following various kinds of processing related to the control method when a specific end operation that is set in advance is performed. The end operation is, for example, the power-off operation of the ship 10.

[4.1.1] Overall Processing

In this embodiment, as an example, the correspondence relation between the operation amount and the output value is changed between the motor propulsion mode in which only the power of the second power source 32 is used for propulsion of the hull 1 and the propulsion mode (engine propulsion mode and hybrid propulsion mode) in which the power of the first power source 31 is used for propulsion of the hull 1. That is, even when the operation amount of the operation acceptor 51 is the same, when only the power of the second power source 32 (motor) having a relatively low maximum output is used for propulsion of the hull 1, and when the power of the first power source 31 (engine) is used for propulsion of the hull 1, the output value (rpm of the propeller) will be different.

Specifically, when the mode switching processor 21 selects the engine propulsion mode or the hybrid propulsion mode as the propulsion mode of the ship 10, the change processor 25 selects allocation data D1 (see FIG. 7) for the engine as the allocation data. In doing so, the adjustment processor 24 adjusts the output value (rpm of the propeller) to a value corresponding to the operation amount of the operation acceptor 51 in accordance with the selected allocation data D1 for the engine. Meanwhile, when the mode switching processor 21 selects the motor propulsion mode as the propulsion mode of the ship 10, the change processor 25 selects allocation data D2 (see FIG. 7) for the motor as the allocation data. In doing so, the adjustment processor 24 adjusts the output value (rpm of the propeller) to a value corresponding to the operation amount of the operation acceptor 51 in accordance with the selected allocation data D2 for the motor.

Figure 7:
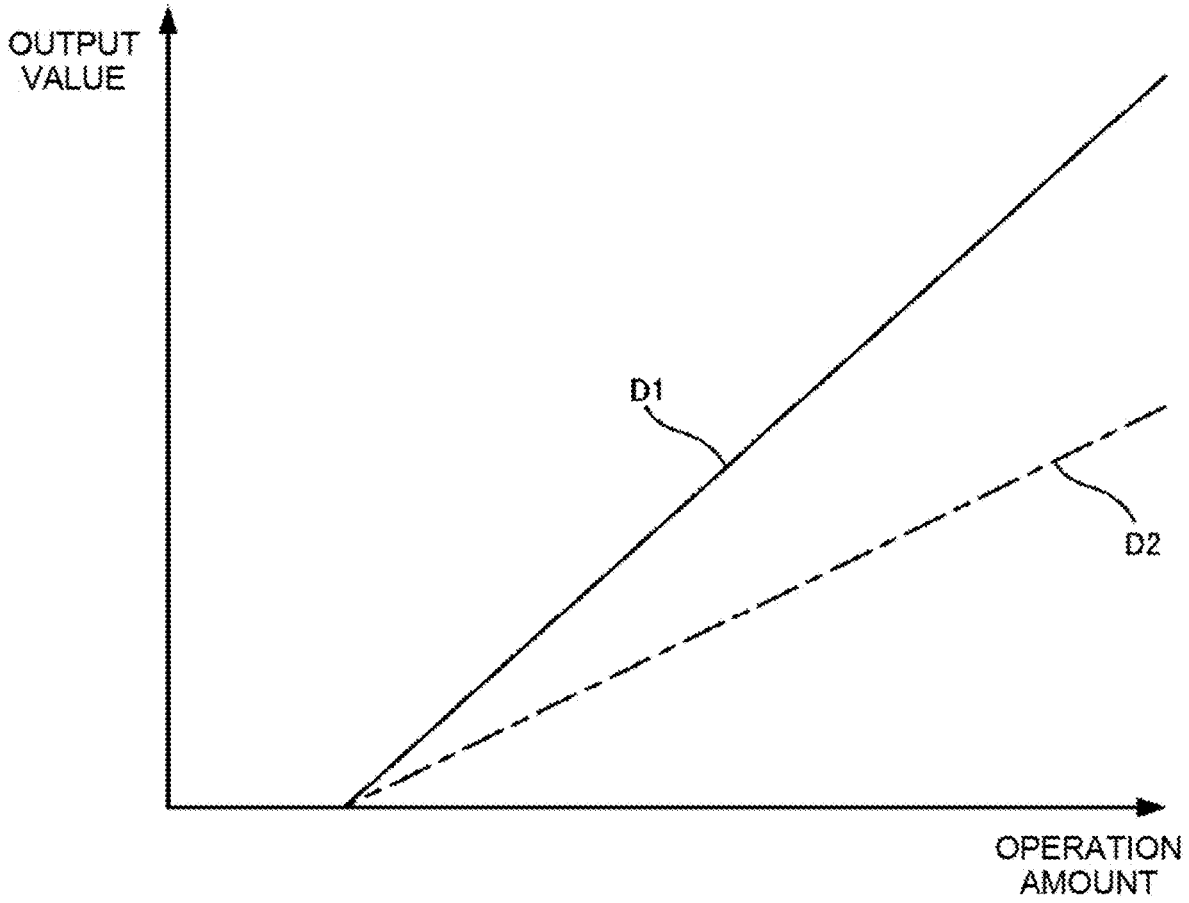
FIG. 7 is a graph illustrating the allocation data used in a ship control system according to the first embodiment.

In this embodiment, as an example, as illustrated in FIG. 7, the allocation data D1 and D2 are set in such a manner that the allocation data D1 for the engine is associated with a larger output value than that of the allocation data D2 for the motor for the same operation amount. FIG. 7 is a graph illustrating the allocation data D1 for an engine and the allocation data D2 for a motor, with the horizontal axis as the operation amount of the operation acceptor 51 and the vertical axis as the output value (rpm of the propeller). As a result, in the propulsion mode in which the power of the first power source 31 (engine) having a relatively high maximum output is used for propulsion of the hull 1, even if the operation amount of the operation acceptor 51 is the same, a larger output value (that is, the propeller rotates at high speed) compared to the motor propulsion mode is associated. In FIG. 7, the correspondence relation between the operation amount and the output value (allocation data D1 and D2) is linear, but is not limited to this, and the correspondence relation may be nonlinear. Furthermore, the output value is set to 0 (zero) in the area where the operation amount is small, but is not limited to this, and an output value greater than 0 may be associated even in the area where the operation amount is small.

The control method according to this embodiment is used for the ship 10 equipped with the plurality of power sources 31 and 32 including the first power source 31 and the second power source 32. The ship 10 has the plurality of propulsion modes in which the power source 31, 32 used for propulsion of the hull 1 is different between the plurality of power sources 31 and 32.

In the control method according to this embodiment, the adjustment processor 24 of the ship control system 2 adjusts the output value related to the propulsive force of the hull 1 to a value corresponding to the operation amount of the operation acceptor 51, with the use of the allocation data D1 and D2 indicating the correspondence relation between the operation amount and the output value as described above. In other words, when the operation amount of the operation acceptor 51 is input, the adjustment processor 24 outputs an output value corresponding to the operation amount on the basis of the allocation data D1 and D2. As a result, the operation amount of the operation acceptor 51 is converted into an output value corresponding to the operation amount by the adjustment processor 24.

Further, in the control method according to this embodiment, the change processor 25 of the ship control system 2 changes the correspondence relation between the operation amount and the output value in accordance with the propulsion mode. More specifically, when the propulsion mode is switched by the mode switching processor 21, the change processor 25 switches the allocation data D1 and D2 used in the adjustment processor 24 to the allocation data D1 and D2 according to the propulsion mode after switching. In other words, the allocation (sensitivity) of the output value (rpm of the propeller) with respect to the operation amount of the operation acceptor 51 is changed by the propulsion mode.

Therefore, even if the operation amount of the operation acceptor 51 is the same, for example, the output value (rpm of the propeller) related to the propulsive force of the hull 1 will be different between the motor propulsion mode and the engine propulsion mode. Further, for each propulsion mode with different power sources 31 and 32, an individual output value (rpm of the propeller) is allocated with respect to the operation amount of the operation acceptor 51, whereby it is possible to perform the operation of the operation acceptor 51 suitable for each propulsion mode. For example, in navigation with the second power source 32 (motor) having a relatively low maximum output, the entire operating range (movable range) of the operation acceptor 51 can be used to adjust the output value (motor rpm). Consequently, the control method according to this embodiment has the advantage that it is easy to improve the operability of the operation acceptor 51.

Further, in this embodiment, the operation state of the operation acceptor 51 includes a drive state and a non-drive state. The "drive state" here is a state where the operation amount of the operation acceptor 51 corresponds to an output value equal to or more than the threshold value, and the "non-drive state" is a state where the operation amount of the operation acceptor 51 corresponds to an output value less than the threshold value. That is, when the operation amount (rotation angle) of the operation acceptor 51 from the neutral position (see FIGS. 6A to 6C) is relatively large and the corresponding output value is equal to or more than the threshold value, the operation state of the operation acceptor 51 is the drive state. In contrast, when the operation amount (rotation angle) of the operation acceptor 51 from the neutral position (see FIGS. 6A to 6C) is minute and the corresponding output value is less than the threshold value (including 0), the operation state of the operation acceptor 51 is the non-drive state. The operation amount of the operation acceptor 51 when the output value becomes the threshold value is, for example, an operation amount in which the rotation angle θ1 (or θ2) of the operation acceptor 51 in FIGS. 6A to 6C is approximately several degrees to several tens of degrees. As an example, assuming that the output value when the rotation angle θ1 (or θ2) is 10 degrees is the threshold value, if the rotation angle θ1 (or θ2) of the operation acceptor 51 is 10 degrees or more, the operation state of the operation acceptor 51 is the drive state, and if the rotation angle θ1 (or θ2) of the operation acceptor 51 is less than 10 degrees, the operation state of the operation acceptor 51 is the non-drive state.

Further, in this embodiment, the propulsion mode can be switched at least in the drive state. That is, if the operation state of the operation acceptor 51 is the drive state, the mode switching processor 21 of the ship control system 2 can switch the propulsion mode. As a result, in a state where the operation state of the operation acceptor 51 is the drive state, that is, in a state where the propulsive force of the hull 1 is generated, the propulsion mode can be switched without performing an operation for returning the operation acceptor 51 to the neutral position.

Furthermore, in this embodiment, the propulsion mode can be switched at least in the non-drive state. That is, if the operation state of the operation acceptor 51 is the non-drive state, the mode switching processor 21 of the ship control system 2 can switch the propulsion mode. This makes it possible to switch the propulsion mode when the operation state of the operation acceptor 51 is the non-drive state, that is, in a state where the propulsive force of the hull 1 is not generated, and in this case, even if the correspondence relation between the operation amount and the output value is changed, the output value is unlikely to change abruptly.

In particular, in this embodiment, the propulsion mode can be switched regardless of whether the operation acceptor 51 is in the drive state or the non-drive state. Therefore, for the navigator who switches the propulsion mode, it is basically possible to switch the propulsion mode regardless of the operation state of the operation acceptor 51, which improves convenience.

However, the control method according to this embodiment restricts, when an output of the first power source 31 is equal to or higher than a predetermined value, switching from a mode in which the first power source 31 is used for propulsion of the hull 1 to a mode in which the first power source 31 is not used for propulsion of the hull 1, among the plurality of propulsion modes. More specifically, if the output (rpm or torque) of the first power source 31 is equal to or higher than a predetermined value, the switching from the engine propulsion mode or hybrid propulsion mode to the motor propulsion mode is restricted. The restriction of switching of the propulsion mode is achieved, for example, by prohibiting the switching operation itself of the propulsion mode by the user (navigator) by locking the mode selection switch of the operation device 5, or by disabling the operation signal due to the mode selection switch being operated. Alternatively, the switching of the propulsion mode may be restricted by, for example, informing the navigator from a display device or the like that the switching of the propulsion mode is restricted.

In this embodiment, in particular, the allocation data D1 for the engine is set to be associated with a larger output value than that of the allocation data D2 for the motor for the same operation amount. Therefore, in a situation where the output of the first power source 31 is equal to or higher than a predetermined value, when the engine propulsion mode or hybrid propulsion mode is switched to the motor propulsion mode, and the allocation data D1 for the engine is switched to the allocation data D2 for the motor, the output value may be significantly decreased. In this embodiment, by restricting the switching from the engine propulsion mode or the hybrid propulsion mode to the motor propulsion mode in such a situation, it is possible to avoid a large decrease in the output value. Accordingly, a significant decrease in the ship speed, or the like can be avoided, leading to improved ship maneuverability.

Furthermore, when the output of the second power source 32 is equal to or higher than a predetermined value, switching from a mode in which the second power source 32 is used for propulsion of the hull 1 to a mode in which the second power source 32 is not used for propulsion of the hull 1 may be restricted. That is, if the output (rpm or torque) of the second power source 32 is equal to or higher than a predetermined value, the switching from the motor propulsion mode to the engine propulsion mode or hybrid propulsion mode may be restricted.

Figure 8:
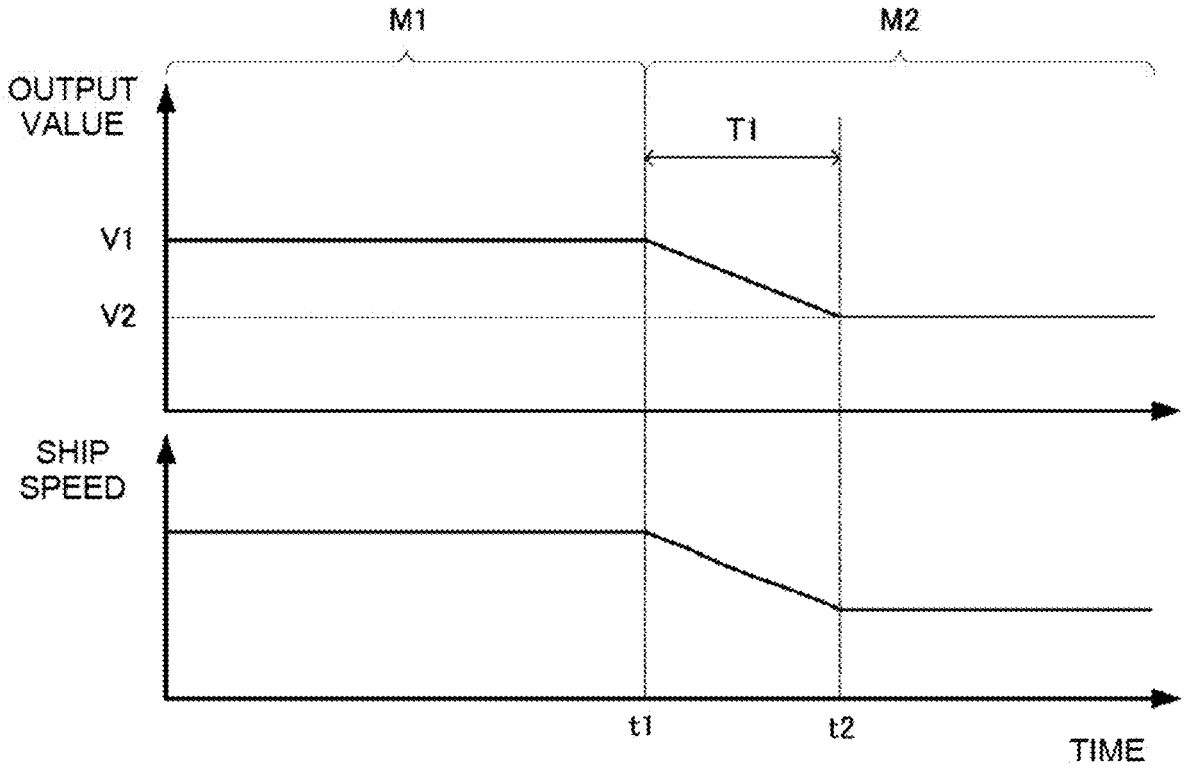
FIG. 8 is a time chart illustrating an example of output values and ship speeds with regard to the ship control system according to the first embodiment.

In the control method according to this embodiment, as illustrated in FIG. 8, with switching from a first mode M1 to a second mode M2 among the plurality of propulsion modes, an intermediate output value between a first output value V1 corresponding to the operation amount in the first mode M1 and a second output value V2 corresponding to the operation amount in the second mode M2 is assigned to the operation amount. FIG. 8 is a graph illustrating the output value (rpm of the propeller) in the upper part and the ship speed in the lower part with the horizontal axis as the time axis. In FIG. 8, as an example, it is assumed that the first mode M1 is the engine propulsion mode and the second mode M2 is the motor propulsion mode. Therefore, even if the operation amount of the operation acceptor 51 is the same, the output value decreases from the first output value V1 to the second output value V2 (<V1) by switching from the first mode M1 (engine propulsion mode) to the second mode M2 (motor propulsion mode). Here, the output value does not decrease sharply (steeply) from the first output value V1 to the second output value V2, but decreases from the first output value V1 to the second output value V2 with the intermediate output value in between. This results in a slower change in the ship speed than when the output value changes abruptly from the first output value V1 to the second output value V2, which improves, for example, the maneuverability, ride quality, and the like of the ship.

Furthermore, in this embodiment, with switching from the first mode M1 to the second mode M2, the first output value V1 is changed to the second output value V2 over a transition time T1 via the intermediate output value. That is, as illustrated in FIG. 8, the output value gradually changes from the first output value V1 to the second output value V2 over a transition time T1 from first time t1 when the propulsion mode is switched from the first mode M1 to the second mode M2 to second time t2. In this embodiment, in particular, in the transition time T1, the first output value V1 is changed continuously to the second output value V2, thereby suppressing a sudden change in the output value and improving the maneuverability, ride quality, and the like of the ship.

In this manner, suppressing a sudden change in the output value due to switching to the propulsion mode is particularly useful when the propulsion mode is switched when the operation state of the operation acceptor 51 is the drive state. That is, in a state where the operation state of the operation acceptor 51 is the drive state, that is, in a state where the propulsive force of the hull 1 is generated, the propulsion mode can be switched without performing an operation for returning the operation acceptor 51 to the neutral position while suppressing a sudden change in the output value due to switching to the propulsion mode.

Here, the transition time T1 may or may not be of a constant length. In this embodiment, if the difference between the first output value V1 and the second output value V2 is less than an allowable value, the transition time T1 is shortened as compared with the case where the difference is equal to or more than the allowable value. That is, the transition time T1 is not of a constant length, and changes in accordance with the amount of change in the output value (difference between the first output value V1 and the second output value V2) due to the switching from the first mode M1 to the second mode M2. For example, if the operation acceptor 51 is in the non-drive state, such as in the neutral position (see FIGS. 6A to 6C) of the operation acceptor 51, the difference between the first output value V1 and the second output value V2 is 0 (zero). In such a case, by shortening the transition time T1, the time required for the change from the first output value V1 to the second output value V2 is shortened. According to this configuration, the transition time T1 becomes short when the difference between the first output value V1 and the second output value V2 is small, and thus even if the output value is changed relatively steeply, there is almost no change in the ship speed. The length of the transition time T1 may be 0 (zero).

On the other hand, if the difference between the first output value V1 and the second output value V2 is equal to or more than the allowable value, the transition time T1 is of a constant length. Therefore, the transition time T1 has the same length when the difference between the first output value V1 and the second output value V2 is a first value and when the difference between the first output value V1 and the second output value V2 is a second value larger than the first value. In other words, regardless of the amount of change in the output value (i.e., change in sensitivity) corresponding to the operation amount of the operation acceptor 51 when the propulsion mode is switched, the output value changes over the transition time T1 of a predetermined time length. As a result, the output value is basically switched at the transition time T1 of a constant length regardless of the operation amount of the operation acceptor 51, and thus the ship maneuverability for the navigator is improved.

[4.1.2] Example of Control System

Next, an example of a control system to embody the processing performed in the ship control system 2, especially in the adjustment processor 24 and the change processor 25, will be described. Here, the output value is an engine target rpm that is the target value of the output of the first power source 31 (engine) or a motor target rpm that is the target value of the output of the second power source 32 (motor).

Figure 9:
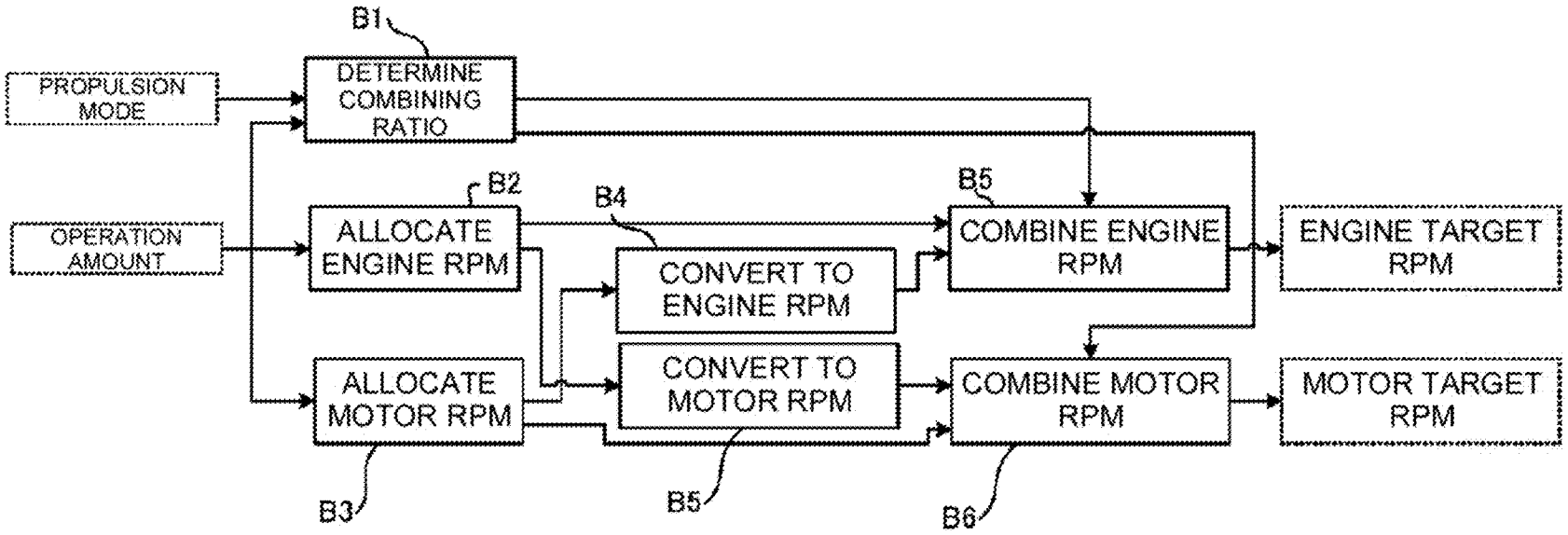
FIG. 9 is a block diagram illustrating an example of the control system of the key part of the ship control system according to the first embodiment.

More specifically, according to the control system such as that illustrated in the block diagram of FIG. 9, when switching the propulsion mode, the intermediate output value between the output value before switching (first output value) and the output value after switching (second output value) can be changed continuously. In the control system illustrated in FIG. 9, the engine target rpm and motor target rpm as output values are output by inputting the propulsion mode and the operation amount of the operation acceptor 51. Specifically, in block B1 of combining ratio determination, a combining ratio α of the allocation data D1 for the engine and the allocation data D2 for the motor is determined in accordance with the propulsion mode and the operation amount of the operation acceptor 51. Here, as an example, the combining ratio α indicates the ratio of the output value based on the allocation data D2 for the motor to the total output value, and changes from "0" to "1". In block B2 of engine rpm allocation, the output value (engine target rpm) V1 corresponding to the operation amount of the operation acceptor 51 is calculated in light of the allocation data D1 for the engine. Similarly, in block B3 of motor rpm allocation, the output value (motor target rpm) V2 corresponding to the operation amount of the operation acceptor 51 is calculated in light of the allocation data D2 for the motor.

In block B4 of engine rpm conversion, the motor target rpm V2 calculated in block B3 is converted into the engine target rpm V2'. In block B5 of motor rpm conversion, the engine target rpm V1 calculated in block B2 is converted into the motor target rpm V1'. In block B5 of engine rpm combining, the engine target rpm is calculated in accordance with equation 1 below. Similarly, in block B6 of motor rpm combining, the motor target rpm is calculated in accordance with equation 2 below.

$$\text{Engine target rpm}=V1*(1-\alpha)+V1'*\alpha; \quad \text{(Equation 1)}$$

$$\text{Motor target rpm}=V2'*(1-\alpha)+V2*\alpha; \quad \text{(Equation 2)}$$

Figure 10:
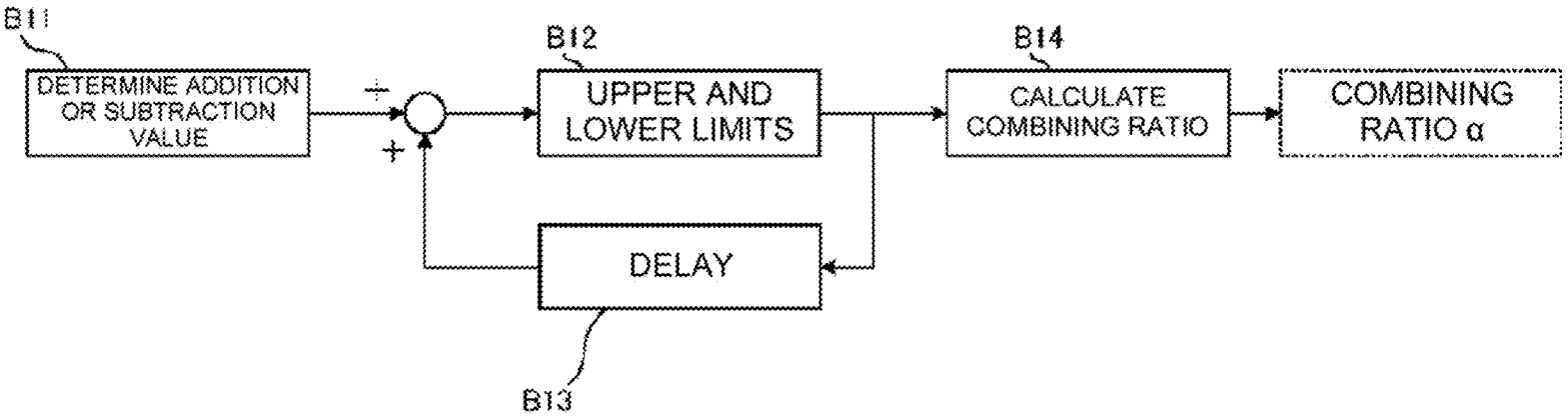
FIG. 10 is a block diagram illustrating an example of the control system of the key part of the ship control system according to the first embodiment.

Further, the combining ratio α is determined by a control system, for example, such as that illustrated in the block diagram of FIG. 10. That is, according to the control system illustrated in FIG. 10, by using a conditional addition/subtraction timer and a combining ratio map according to the timer value, block B1 of combining ratio determination can gradually change the combining ratio α in conjunction with the switching of the propulsion mode. Specifically, in block B11 of addition or subtraction value determination, an addition value or a subtraction value is determined in accordance with the switching of the propulsion mode. The timer value is output from block B12 of upper and lower limits, and in block B13 of delay, the timer value is fed back with a delay of one sampling cycle. Therefore, the timer value is added (or subtracted) at each sampling cycle, and increases (or decreases) in increments of the addition (or subtraction) value. In block B12 of upper and lower limits, the timer value is limited to a predetermined range. In block B14 of combining ratio calculation, the combining ratio α corresponding to the timer value is calculated in light of the combining ratio map. When the timer value is at the lower limit of the predetermined range, the combining ratio α is "0", and when the timer value is at the upper limit of the predetermined range, the combining ratio α is "1".

Here, when switching from the engine propulsion mode or hybrid propulsion mode to the motor propulsion mode, block B11 of addition or subtraction value determination outputs an addition value, and the timer value gradually increases to the upper limit value. Conversely, when switching from the motor propulsion mode to engine propulsion mode or hybrid propulsion mode, block B11 of addition or subtraction value determination outputs an addition value, and the timer value gradually decreases to the lower limit value. The larger the addition value or the subtraction value, the shorter the transition time T1. Thus, in this embodiment, if the difference between the first output value V1 and the second output value V2 is less than the allowable value, the addition value or the subtraction value becomes a relatively large value. On the other hand, if the difference between the first output value V1 and the second output value V2 is equal to or more than the allowable value, the magnitude of the addition value or the subtraction value is set in such a manner that the transition time T1 until the timer value reaches the upper limit value or the lower limit value has a constant length.

However, the control system illustrated in FIGS. 9 and 10 is merely an example, and for example, the combining ratio $\alpha$ may be determined by other methods.

[4.1.3] Flowchart

Figure 11:
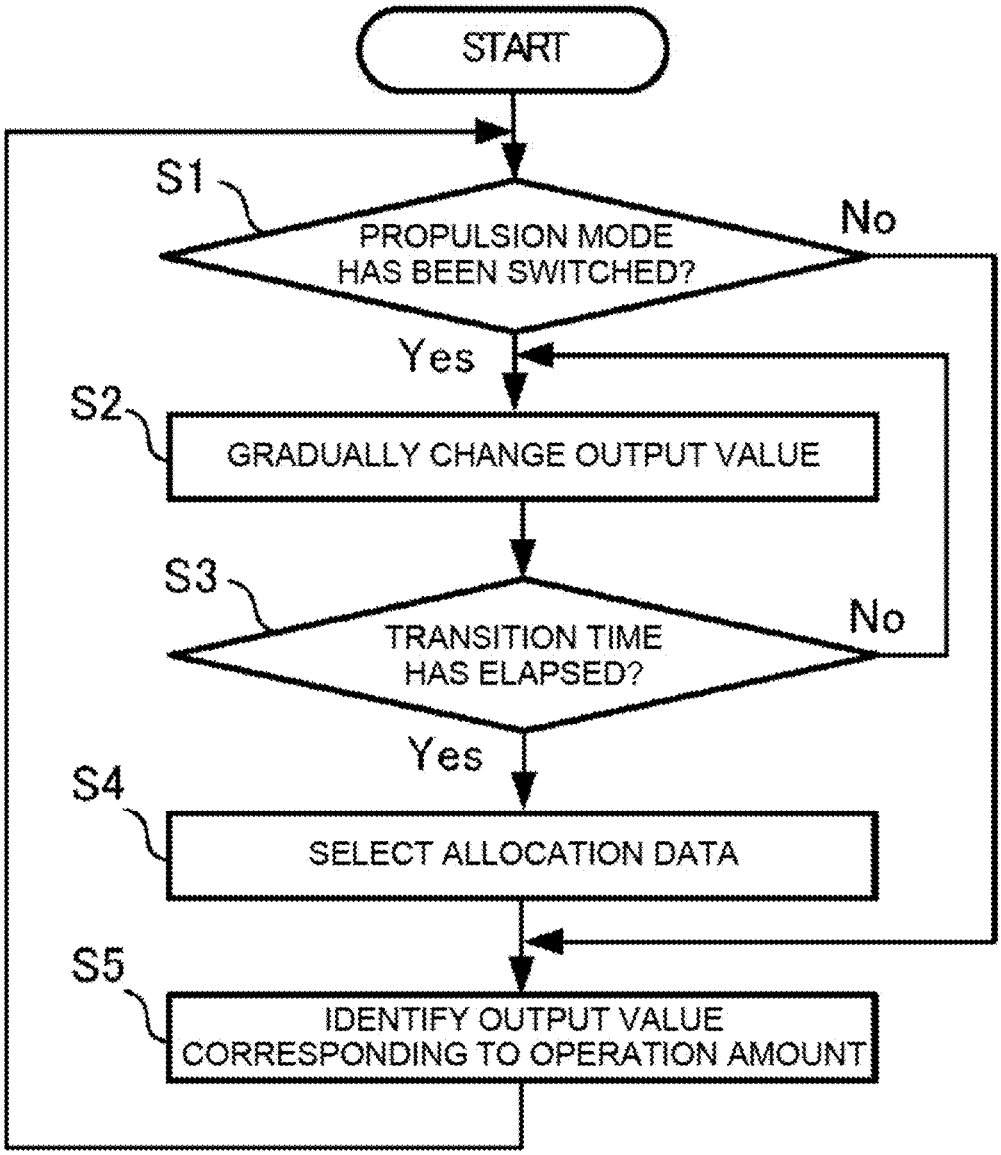
FIG. 11 is a flowchart of an example of the operation of the ship control system according to the first embodiment.

Next, the overall flow of the processing for the control method of the ship 10 will be described with reference to the flowchart in FIG. 11.

That is, in the control method according to this embodiment, the ship control system 2 determines whether the propulsion mode has been switched by the mode switching processor 21 (S1). If the propulsion mode has been switched (S1: Yes), the ship control system 2 shifts the processing to step S2. On the other hand, if the propulsion mode has not been switched (S1: No), the ship control system 2 shifts the processing to step S5.

In step S2, the ship control system 2 gradually changes the output value from the output value (first output value V1) in the propulsion mode (first mode M1) before switching to the output value (second output value V2) in the propulsion mode (second mode M2) after switching. In step S3, the ship control system 2 determines whether the transition time T1 has elapsed. If the transition time T1 has not elapsed (S3: No), the ship control system 2 returns the processing to step S2 and continuously changes the output value. If the transition time T1 has elapsed (S3: Yes), the ship control system 2 shifts the processing to step S4.

In step S4, the ship control system 2 selects the allocation data associated with the output value (second output value V2) in the propulsion mode (second mode M2) after switching. In doing so, the change processor 25 of the ship control system 2 changes the correspondence relation between the operation amount of the operation acceptor 51 and the output value. After that, in step S5, using the allocation data being selected, the adjustment processor 24 of the ship control system 2 identifies the output value corresponding to the operation amount of the operation acceptor 51. In other words, the adjustment processor 24 converts the operation amount of the operation acceptor 51 into an output value corresponding to that operation amount.

The ship control system 2 repeats the processing of the above steps S1 to S5. However, the flowchart illustrated in FIG. 11 is merely an example, and the processing may be added or omitted as appropriate, or the order of processing may be swapped as appropriate.

[4.2.1] Overall Processing

The control method according to this embodiment is used for the ship 10 equipped with the plurality of power sources 31 and 32 including an engine (first power source 31) and a motor (second power source 32). The ship 10 has the plurality of propulsion modes in which the power source 31, 32 used for propulsion of the hull 1 is different between the plurality of power sources 31 and 32. Furthermore, the ship 10 is provided with a clutch (first clutch 331) at least between the engine (first power source 31) and the output section 4 that generates the propulsive force of the hull 1. Here, the plurality of propulsion modes include the hybrid propulsion mode in which both the engine (first power source 31) and the motor (second power source 32) are used for propulsion of the hull 1 and the motor propulsion mode in which the motor (second power source 32) is used for propulsion of the hull 1.

The control method according to this embodiment includes, when the motor propulsion mode is switched to the hybrid propulsion mode, before the clutch (first clutch 331) is switched from the disconnected state to the transmission state, synchronizing the rpm of the engine (first power source 31) with the rpm of the motor (second power source 32) and controlling the torque of the motor (second power source 32) during a torque control period after the rpm is synchronized.

More specifically, when the propulsion mode of the ship 10 is switched from the motor propulsion mode to the hybrid propulsion mode, before the first clutch 331 is switched, the engine rpm processor 24 of the ship control system 2 synchronizes the rpm of the engine (first power source 31) with the rpm of the motor (second power source 32). In doing so, the engine rpm processor 24 controls the rpm of the first power source 31 (engine), thereby synchronizing the rpm of the engine (first power source 31) and the rpm of the motor (second power source 32). Then, after the rpm of the engine (first power source 31) is synchronized with the rpm of the motor (second power source 32), the motor torque processor 25 of the ship control system 2 switches the control of the motor (second power source 32) to the torque control. As a result, the torque of the motor (second power source 32) can be maintained even after the first clutch 331 is switched to the transmission state, and it becomes easy to suppress a sudden torque change in the first clutch 331.

In this manner, in the control method according to this embodiment, when switching from the disconnected state of the clutch (first clutch 331) to the transmission state due to the switching of the propulsion mode of the ship 10, the rpm of the engine (first power source 31) can be synchronized with the rpm of the motor (second power source 32). As a result, the input side revolving body 331A connected to the engine (first power source 31) can be smoothly connected to the output side revolving body 331B connected to the motor (second power source 32). Moreover, after the first clutch 331 is switched to the transmission state, the torque of the motor (second power source 32) is maintained, and it thereby becomes easy to suppress a sudden torque change in the first clutch 331, and thus it is possible to reduce the load on the clutch due to the torque change. Consequently, there is an advantage that the load on the clutch (first clutch 331) when switching the propulsion mode can be reduced.

In short, when the propulsion mode of the ship 10 is the motor propulsion mode and the propulsion mode is switched to the hybrid propulsion mode in the state where the propeller of the output section 4 is driven (rotated) by the power of the motor (second power source 32), it is necessary to connect, via the first clutch 331, the engine (first power source 31) to the output section 4 (propeller) being driven. In doing so, if a sudden torque change occurs between the input side revolving body 331A and the output side revolving body 331B of the first clutch 331, an excessive load is applied to the first clutch 331, and depending on the environment at that time, the first clutch 331 may be burnt in the worst case. According to the control method according to this embodiment, when the motor propulsion mode is switched to the hybrid propulsion mode, the load on the clutch (first clutch 331) can be reduced, and thus burning of the first clutch 331 or the like is less likely to occur.

[4.2.2] Processing when Clutch is Connected

Figure 13:
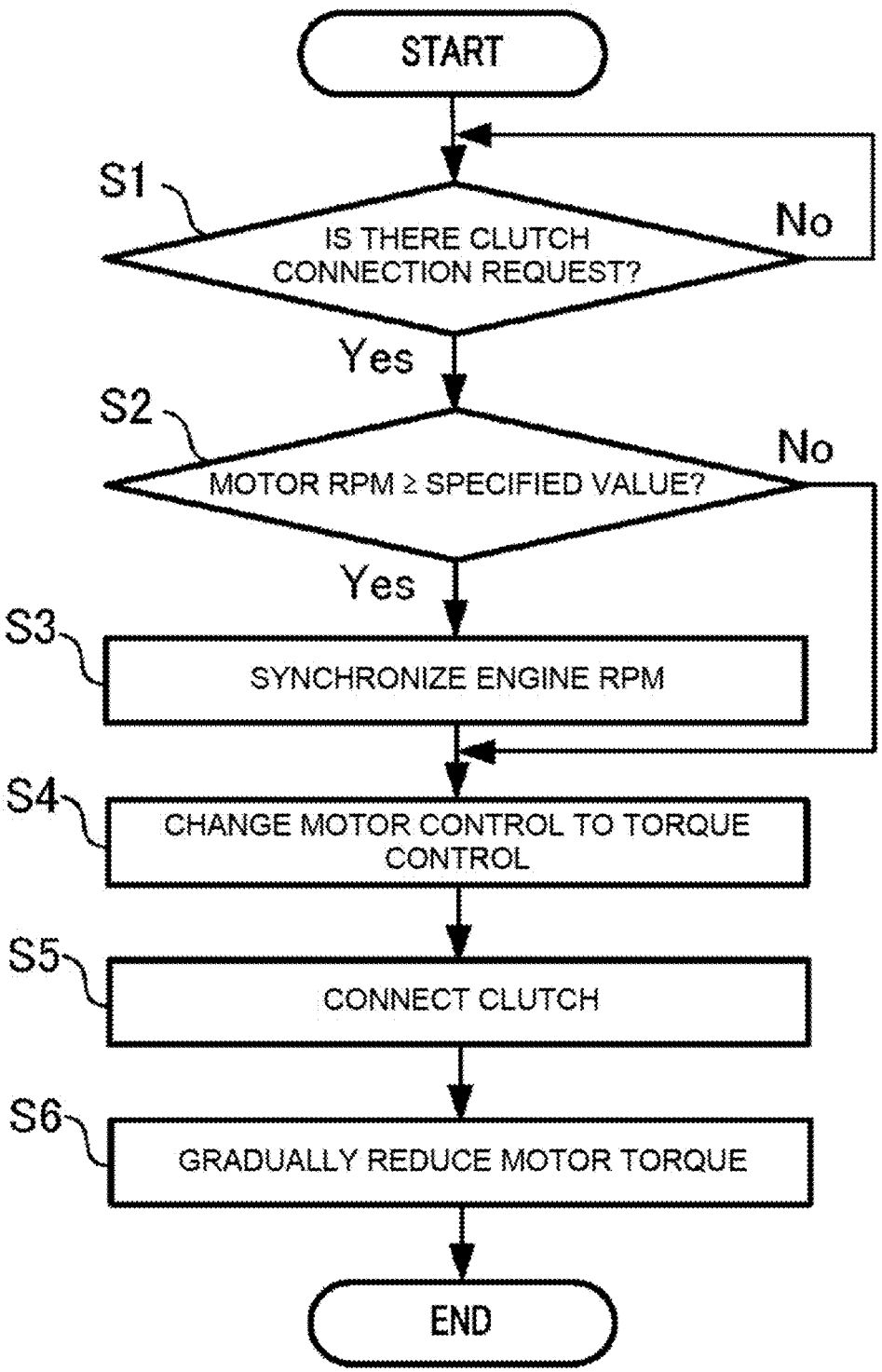
FIG. 13 is a flowchart illustrating an example of the processing when a first clutch is connected in the ship control system according to the first embodiment.
Figure 14:
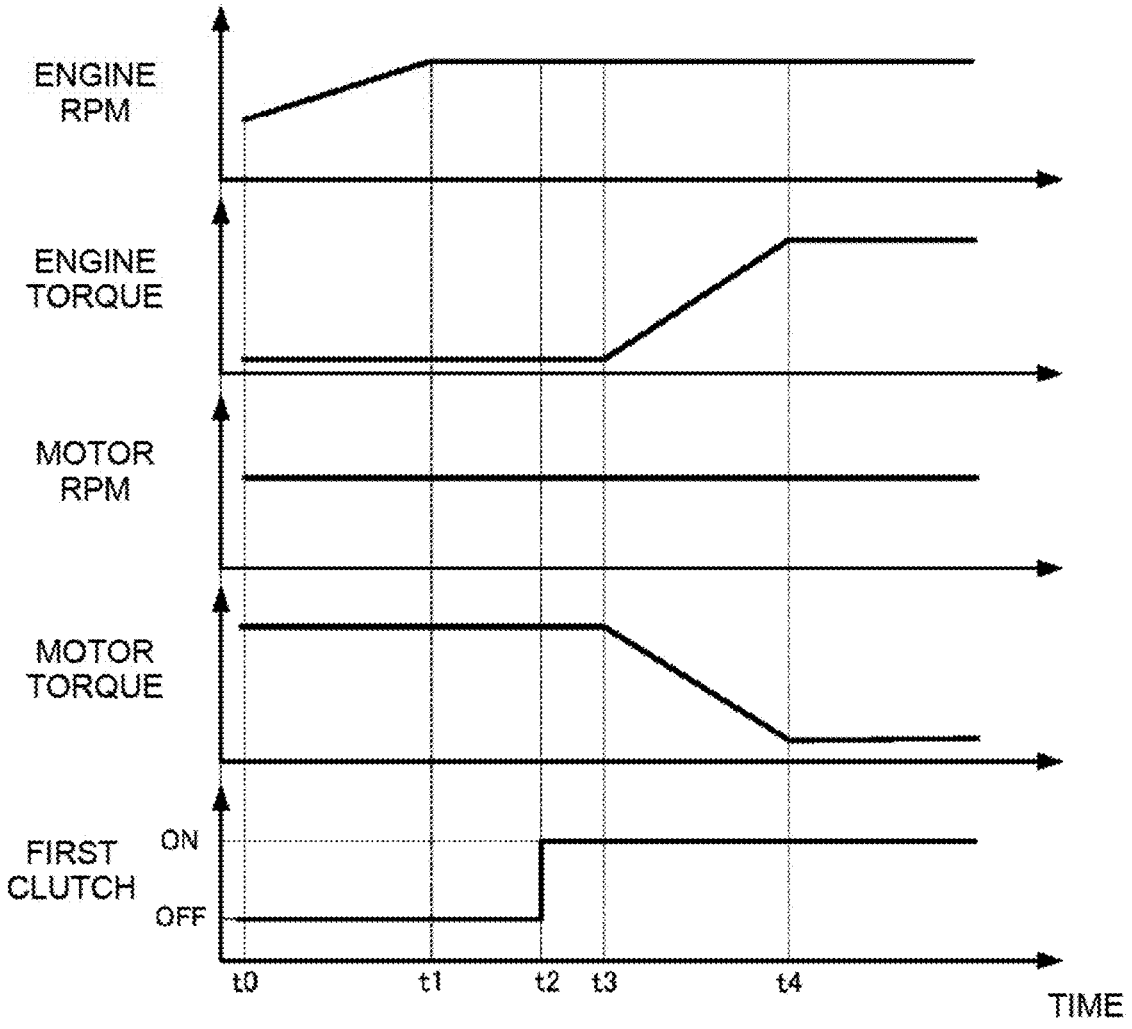
FIG. 14 is a timing chart illustrating an example of the processing when the first clutch is connected in the ship control system according to the first embodiment.

Next, with reference to FIGS. 13 and 14, the processing when the first clutch 331 is connected, that is, when the disconnected state is switched to the transmission state in the control method according to this embodiment will be described in detail. FIG. 14 is an example of a timing chart when the first clutch 331 is connected, which illustrates the engine rpm, engine torque, motor rpm, motor torque, and state of the first clutch 331. Here, as the state of the first clutch 331, the transmission state where the input side revolving body 331A and the output side revolving body 331B are connected is "ON", and the disconnected state where the input side revolving body 331A and the output side revolving body 331B are disconnected is "OFF".

More specifically, in the control method according to this embodiment, the ship control system 2 determines whether there is a clutch connection request instructing the switching from the disconnected state to the transmission state of the first clutch 331 (S1). As an example, when the propulsion mode of the ship 10 is switched from the motor propulsion mode to the hybrid propulsion mode (low speed), or the like, it is necessary to switch to the transmission state of the first clutch 331 with the switching of the propulsion mode, and the clutch connection request is made. Therefore, if the motor propulsion mode has been switched to the hybrid propulsion mode (low speed), the ship control system 2 determines that there is a clutch connection request (S1: Yes), and shifts the processing to step S2. On the other hand, if switching of the propulsion mode with switching to the transmission state of the first clutch 331 has not been performed, the ship control system 2 determines that there is no clutch connection request (S1: No), and repeatedly executes step S1.

In step S2, the ship control system 2 determines whether the rpm of the motor (second power source 32) is equal to or higher than a specified value. Here, the specified value is the rpm of the motor (second power source 32) when the minimum value (minimum rpm) of the rpm of the input side revolving body 331A in the range adjustable by the control of the first power source 31 and the rpm of the output side revolving body 331B are the same, such as the rpm of the input side revolving body 331A when the engine (first power source 31) is idling. Then, if determining that the rpm of the motor (second power source 32) is equal to or higher than the specified value (S2: Yes), the ship control system 2 shifts the processing to step S3. On the other hand, if determining that the rpm of the motor (second power source 32) is lower than the specified value (S2: No), the ship control system 2 skips step S3 and shifts the processing to step S4.

In step S3, the engine rpm processor 24 of the ship control system 2 synchronizes the rpm of the engine (first power source 31) with the rpm of the motor (second power source 32). In doing so, the ship control system 2 controls the rpm of the engine (first power source 31) by the engine controller 22 in such a manner that the rpm of the input side revolving body 331A substantially matches the rpm of the output side revolving body 331B. Specifically, in the example of FIG. 14, the rpm of the engine (first power source 31) is increased from time to, and at time t1, the rpm of the engine (first power source 31) synchronizes with the rpm of the motor (second power source 32).

In this manner, in the control method according to this embodiment, when the motor propulsion mode is switched to the hybrid propulsion mode, the processing of synchronizing the rpm of the engine (first power source 31) with the rpm of the motor is enabled/disabled by the rpm of the motor (second power source 32). If the rpm of the motor (second power source 32) is equal to or higher than the specified value, the processing of synchronizing the rpm of the engine (first power source 31) with the rpm of the motor is enabled, and if the rpm of the motor is lower than the specified value, the processing of synchronizing the rpm of the engine with the rpm of the motor is disabled. More specifically, if the rpm of the motor (second power source 32) is lower than the specified value, no matter how the first power source 31 is controlled, it is not possible to synchronize (match) the rpm of the input side revolving body 331A with the rpm of the output side revolving body 331B. Further, at such low rpm, the torque applied to the first clutch 331 when the first clutch 331 is connected is also relatively small, and therefore the load on the first clutch 331 can be kept small even without synchronizing the engine rpm. Further, by skipping the processing of synchronizing the engine rpm (S3), it is possible to shorten the time required to connect the first clutch 331.

In step S4, the motor torque processor 25 of the ship control system 2 changes the control of the second power source 32 (motor) by the motor controller 23 from the rpm control to the torque control. That is, in the example of FIG. 14, after time t1 when the rpm of the engine (first power source 31) is synchronized with the rpm of the motor (second power source 32), as the torque control period, the ship control system 2 controls the torque of the motor (second power source 32). Strictly speaking, from time t1 to time t2, the ship control system 2 determines whether the engine rpm has been synchronized with the motor rpm. At time t2 when confirming the synchronization, the ship control system 2 changes the control of the second power source 32 (motor) from the rpm control to the torque control.

In step S5, the ship control system 2 connects the first clutch 331. That is, at time t2 in FIG. 14, the state of the first clutch 331 is switched from the disconnected state (OFF) to the transmission state (ON). In doing so, the ship control system 2 maintains the torque of the motor (second power source 32) within a predetermined range at least until the clutch (first clutch 331) transitions to the transmission state during the torque control period. That is, in the torque control period, even after time t2 when the connection of the first clutch 331 is started, the torque of the second power source 32 is maintained within a predetermined range until the first clutch 331 transitions to the transmission state, that is, until the first clutch 331 is completely connected. Here, the "predetermined range" can be freely set by the lower limit value and the upper limit value. For example, by setting the lower limit value and the upper limit value of a predetermined range to the same value, the width of the predetermined range can be set to 0 (zero), and the predetermined range can be set in a pinpoint manner. In this case, the predetermined range is synonymous with a predetermined value, and thus the torque of the motor (second power source 32) is maintained at the predetermined value (maintained constant) during the torque control period.

In this embodiment, the width of the predetermined range is set to 0 (zero), and the torque is set to the torque of the motor (second power source 32) at time t2 when the connection of the first clutch 331 is started. As a result, the torque of the second power source 32 (motor) is maintained at a constant value before and after the first clutch 331 is connected. Accordingly, before and after the first clutch 331 is connected, the torque required for driving the output section 4 can be covered by the second power source 32 (motor), and no torque is required on the first power source 31 (engine) side. Therefore, the load on the first clutch 331 can be kept small.

In this state, the state of the first clutch 331 is switched from the disconnected state (OFF) to the transmission state (ON), and the first clutch 331 is connected (S5). After that, in step S6, the ship control system 2 gradually reduces the torque of the second power source 32 (motor). In the example of FIG. 14, the motor controller 23 gradually reduces the torque of the second power source 32 (motor) over a transition time from time t3 to time t4. With this, the ship control system 2 ends a series of processing related to the connection of the first clutch 331.

In this manner, in the torque control period, after the clutch (first clutch 331) transitions to the transmission state, the torque of the motor (second power source 32) is varied over the transition time. In doing so, of the torque required to drive the output section 4, the reduction in the torque of the second power source 32 (motor) is covered by the first power source 31 (engine). Therefore, the torque of the engine (first power source 31) gradually increases over the transition time from time t3 to time t4. That is, the torque of the engine (first power source 31) increases passively. Accordingly, of the torque required to drive the output section 4, the distribution of torque between the motor (second power source 32) and the engine (first power source 31) gradually changes in the transition time. Consequently, the load on the first clutch 331 due to a sudden torque change is suppressed.

In particular, in this embodiment, in step S6, when the torque of the motor (second power source 32) is changed (reduced here) over the transition time, the motor controller 23 controls the torque of the second power source 32 in such a manner that the torque changes smoothly. That is, the torque of the motor (second power source 32) is continuously changed during the transition time. Accordingly, it is possible to suppress the load on the first clutch 331 due to a sudden torque change as compared with the case where a discontinuous change such that the torque of the motor gradually decreases occurs.

The ship control system 2 repeats the processing of the above steps S1 to S6. However, the flowchart illustrated in FIG. 13 is merely an example, and the processing may be added or omitted as appropriate, or the order of processing may be swapped as appropriate.

[4.2.3] Processing when Clutch is Disconnected

Figure 15:
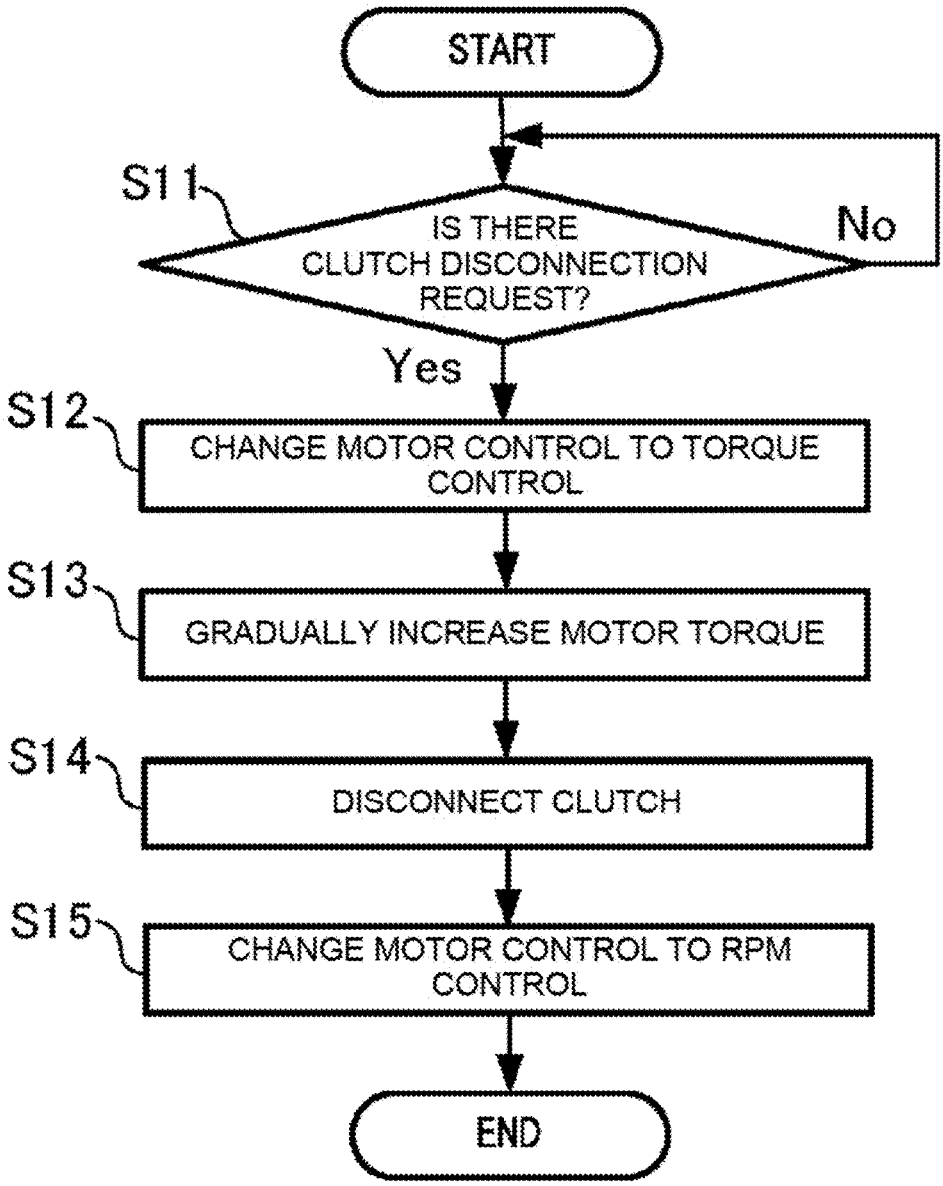
FIG. 15 is a flowchart illustrating an example of the processing when the first clutch is disconnected in the ship control system according to the first embodiment.
Figure 16:
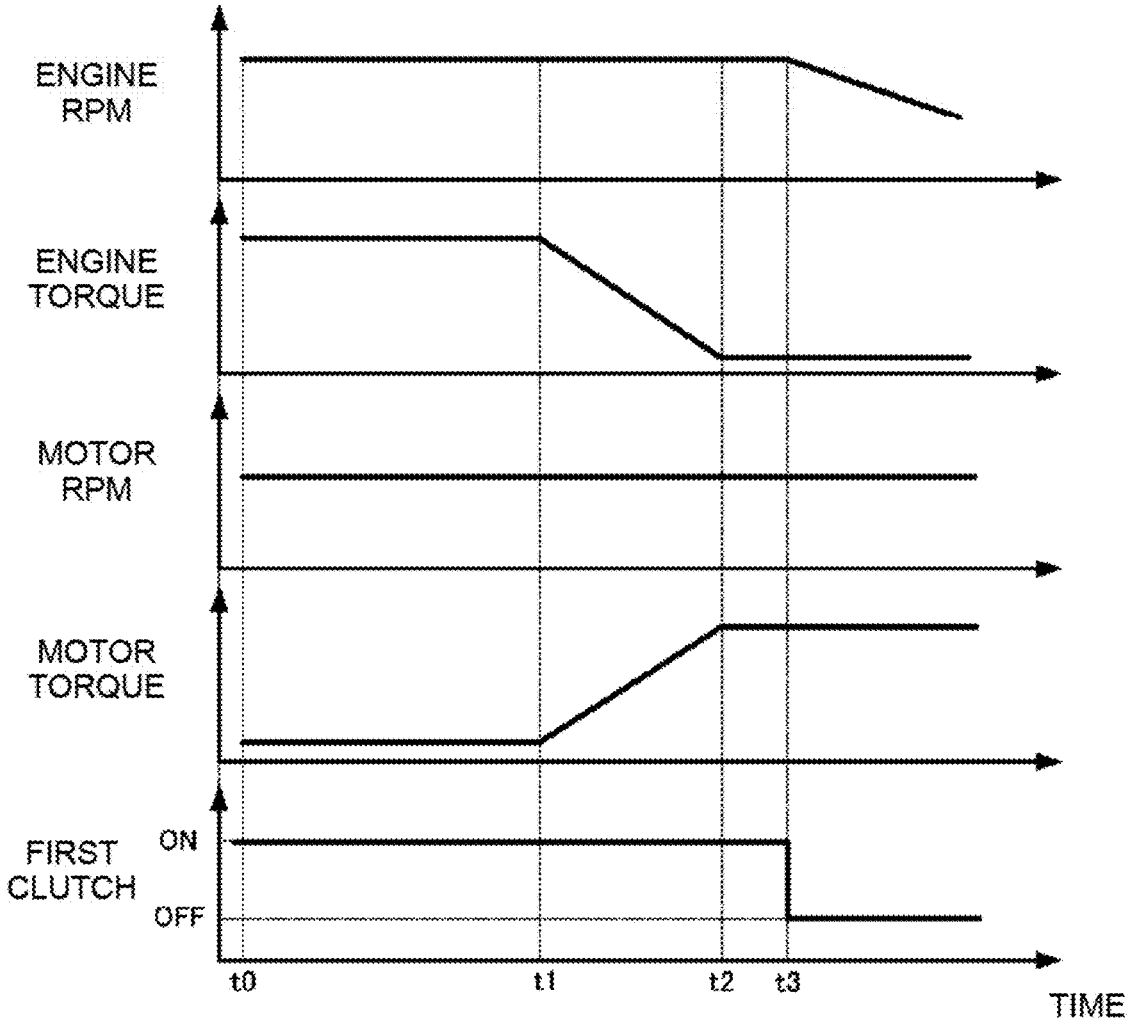
FIG. 16 is a timing chart illustrating an example of the processing when the first clutch is disconnected in the ship control system according to the first embodiment.

Next, with reference to FIGS. 15 and 16, the processing when the first clutch 331 is disconnected, that is, when the transmission state is switched to the disconnected state in the control method according to this embodiment will be described in detail. FIG. 16 is an example of a timing chart when the first clutch 331 is disconnected, which illustrates the engine rpm, engine torque, motor rpm, motor torque, and state of the first clutch 331.

More specifically, in the control method according to this embodiment, the ship control system 2 determines whether there is a clutch disconnection request instructing the switching from the transmission state to the disconnected state of the first clutch 331 (S11). As an example, when the propulsion mode of the ship 10 is switched from the hybrid propulsion mode (low speed) to the motor propulsion mode, or the like, it is necessary to switch to the disconnected state of the first clutch 331 with the switching of the propulsion mode, and the clutch disconnection request is made. Therefore, if the hybrid propulsion mode (low speed) has been switched to the motor propulsion mode, the ship control system 2 determines that there is a clutch disconnection request (S11: Yes), and shifts the processing to step S12. On the other hand, if switching of the propulsion mode with switching to the disconnected state of the first clutch 331 has not been performed, the ship control system 2 determines that there is no clutch disconnection request (S11: No), and repeatedly executes step S11.

In step S12, before the clutch (first clutch 331) is switched from the transmission state to the disconnected state, the motor torque processor 25 of the ship control system 2 changes the control of the second power source 32 (motor) by the motor controller 23 to the torque control. That is, in the example of FIG. 16, before time t3 when the clutch (first clutch 331) is switched from the transmission state to the disconnected state, the torque of the second power source 32 (motor) is controlled by the motor controller 23. In short, in the control method according to this embodiment, when the hybrid propulsion mode is switched to the motor propulsion mode, before the clutch (first clutch 331) is switched from the transmission state to the disconnected state, the torque of the motor (second power source 32) is controlled.

In a next step S13, the ship control system 2 gradually increases the torque of the second power source 32 (motor). In the example of FIG. 16, the motor controller 23 gradually increases the torque of the second power source 32 (motor) over a transition time from time t1 to time t2. In doing so, of the torque required to drive the output section 4, the distribution of the first power source 31 (engine) decreases by the amount of increase in the torque of the second power source 32 (motor). Therefore, the torque of the engine (first power source 31) gradually decreases over the transition time from time t1 to time t2. That is, the torque of the engine (first power source 31) decreases passively. Accordingly, when the clutch (first clutch 331) is disconnected, the torque of the engine (first power source 31) has already decreased, and the over-revolution in which the rpm of the engine (first power source 31) becomes excessive is suppressed when the first clutch 331 is disconnected.

In particular, in this embodiment, in step S13, when the torque of the motor (second power source 32) is changed (increased here) over the transition time, the motor controller 23 controls the torque of the second power source 32 in such a manner that the torque changes smoothly. That is, the torque of the motor (second power source 32) is continuously changed during the transition time. Accordingly, it is possible to suppress the load on the first clutch 331 due to a sudden torque change as compared with the case where a discontinuous change such that the torque of the motor gradually decreases occurs.

In step S14, the ship control system 2 disconnects the first clutch 331. That is, at time t3 in FIG. 16, the state of the first clutch 331 is switched from the transmission state (ON) to the disconnected state (OFF). In doing so, the ship control system 2 changes the control of the second power source 32 (motor) by the motor controller 23 from the torque control to the rpm control (S15). That is, in the example of FIG. 16, after time t3 when the first clutch 331 is disconnected, the ship control system 2 controls the rpm of the motor (second power source 32). With this, the ship control system 2 ends a series of processing related to the connection of the first clutch 331.

In this manner, in the control method according to this embodiment, when the clutch (first clutch 331) is switched from the transmission state to the disconnected state, the control of the motor (second power source 32) is switched from the torque control to the rpm control. As a result, after the first clutch 331 is disconnected and the propulsion mode is shifted to the motor propulsion mode, it is possible to quickly control the output section 4 by controlling the rpm of the motor (second power source 32).

The ship control system 2 repeats the processing of the above steps S11 to S15. However, the flowchart illustrated in FIG. 15 is merely an example, and the processing may be added or omitted as appropriate, or the order of processing may be swapped as appropriate.

[4.2.4] Example of Control System

Figure 17:
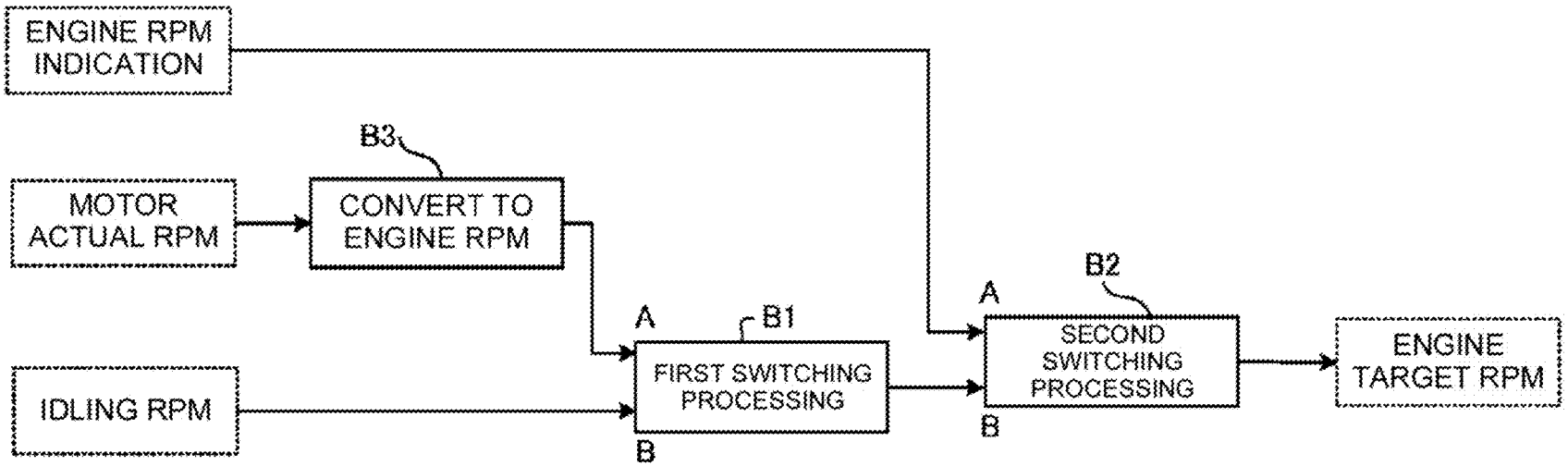
FIG. 17 is a block diagram illustrating an example of the control system of the key part of the ship control system according to the first embodiment.
Figure 18:
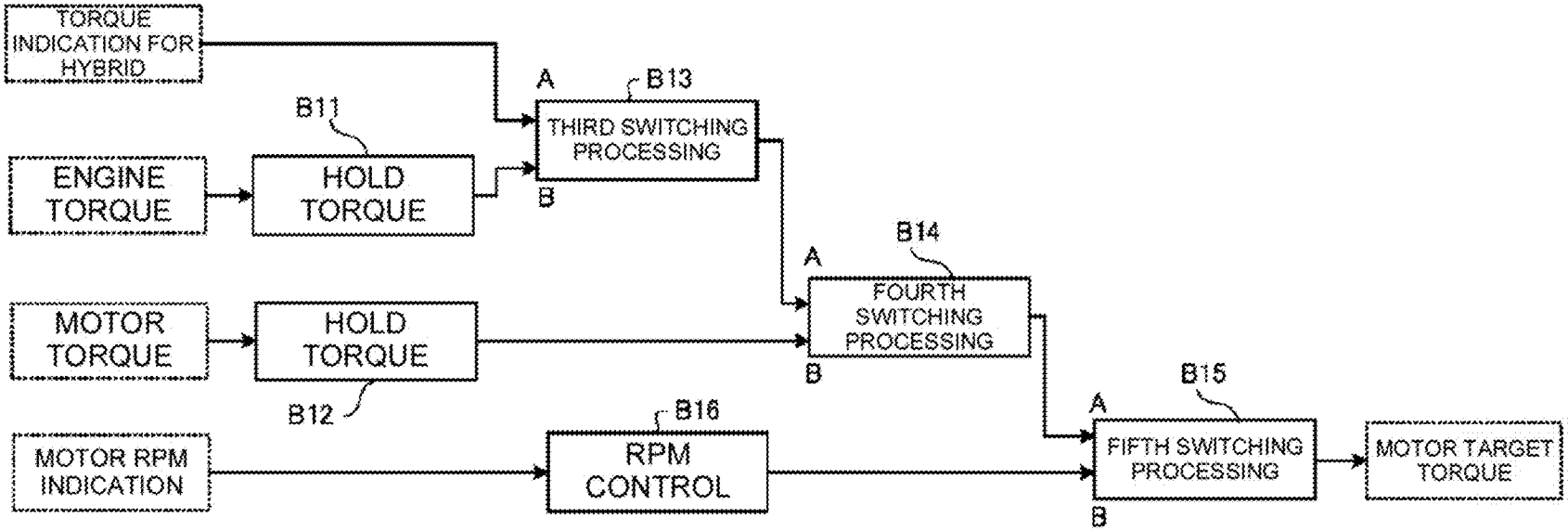
FIG. 18 is a block diagram illustrating an example of the control system of the key part of the ship control system according to the first embodiment.
Figure 19:
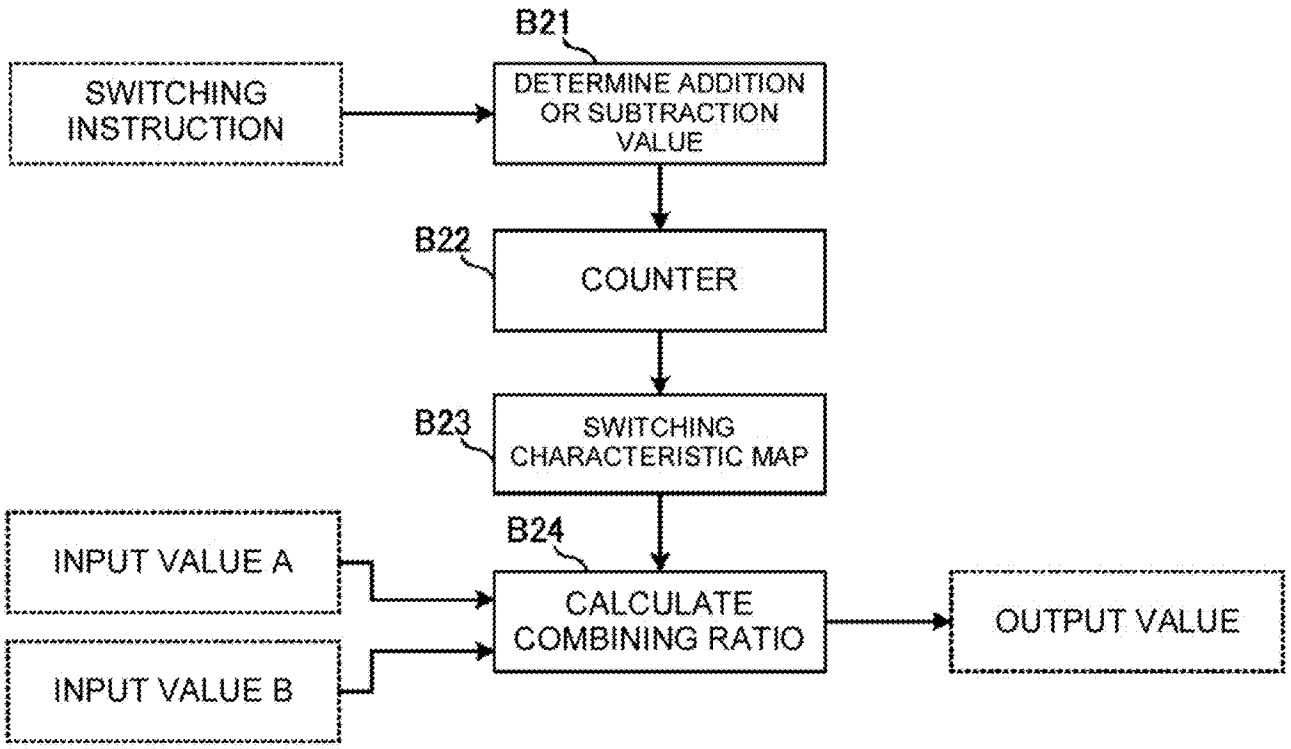
FIG. 19 is a block diagram illustrating an example of the control system of the key part of the ship control system according to the first embodiment.

Next, an example of a control system to embody the processing performed in the ship control system 2, especially in the engine rpm processor 24 and the motor torque processor 25 will be described. FIG. 17 illustrates a control system that generates a target rpm of the first power source 31 in the rpm control of the engine (first power source 31). FIG. 18 illustrates a control system that generates a target torque of the second power source 32 in the torque control of the motor (second power source 32). FIG. 19 illustrates an example of the switching processing block of FIGS. 17 and 18.

In the block diagram of FIG. 17, in block B3 of engine rpm conversion, a motor rpm is converted into an engine rpm. In the block diagram of FIG. 18, block B11 of torque holding, an engine torque is held, and in block B12 of torque holding, a motor torque is held. In the block diagram of FIG. 18, in block B16 of rpm control, the rpm control calculation of the motor (second power source 32) is performed to generate a target torque. Block B1 of the first switching processing and block B2 of the second switching processing in FIGS. 17, and B13 of the third switching processing block, B14 of the fourth switching processing block, and B15 of the fifth switching processing block in FIG. 18 are implemented by the control system such as that illustrated in FIG. 19. These switching processing blocks combine an input value A (a value input to A) and an input value B (a value input to B) with the use of the combining ratio $\alpha$ in accordance with the switching instruction from the outside and output a combined value as the output value. Here, as an example, the combining ratio $\alpha$ indicates the ratio of the input value B to the total output value, and changes from "0" to "1".

According to the control system illustrated in FIG. 19, in block B21 of addition or subtraction value determination, an addition value or a subtraction value is determined in accordance with the switching instruction. The block B22 of counter outputs a counter value that increases (or decreases) in increments of the addition (or subtraction) value. In block B23 of switching characteristic map, the combining ratio $\alpha$ corresponding to the counter value is calculated in light of the switching characteristic map. In block B24 of combining ratio calculation, the output value is calculated in accordance with equation 1 below using the combining ratio $\alpha$.

$$\text{Output value}=\text{input value } A^*(1-\alpha)+\text{input value } B^*\alpha; \quad \text{(Equation 1)}$$

As a result, when receiving the instruction to switch from the input value A to the input value B, the switching processing block gradually changes the output value from the input value A to the input value B. Therefore, in the block diagram of FIG. 17, the engine rpm can be continuously changed as illustrated in FIG. 14, and in the block diagram of FIG. 18, the motor torque can be continuously changed as illustrated in FIG. 14.

The operation in such a configuration will be described in which while the hull 1 is navigating in the motor propulsion mode, when the engine (first power source 31) is connected and the propulsion mode is switched to the hybrid propulsion mode, that is, when the first clutch 331 is connected. First, in the motor propulsion mode, block B1 of the first switching processing and block B2 of the second switching processing in FIG. 17 and block B15 of the fifth switching processing in FIG. 18 output the input value B as the output value. Other than that, block B13 of the third switching processing and block B14 of the fourth switching processing output the input value A as the output value.

From this state, the output value of block B1 of the first switching processing is switched from the input value B to the input value A, and thus the target rpm of the engine (first power source 31) is determined in such a manner that the engine rpm is synchronized with the motor rpm. In doing so, in block B1 of the first switching processing, the engine rpm is gradually synchronized with the motor rpm by gradually switching from the input value B (idling rpm) to the input value A (engine rpm equivalent to the motor actual rpm). Here, a synchronization determination is made, and after it is determined that the engine rpm has synchronized with the motor rpm, the first clutch 331 is connected, i.e., switching from the disconnected state to the transmission state is performed.

In doing so, at the same time as the connection of the first clutch 331, the output value of the block B14 of the fourth switching processing is switched from the input value A to the input value B, and the output value of the block B15 of the fifth switching processing is switched from the input value B to the input value A. In doing so, in the block B14 of the fourth switching processing, the input value A is instantly switched to the input value B. Here, the input value B in the block B14 of the fourth switching processing is the block B12 of the torque holding, and thus as a result, the motor torque immediately before the connection of the first clutch 331 is held. Here, in the block B15 of the fifth switching processing, the input value B (motor torque equivalent to the motor rpm indication) is instantly switched to the input value A (output value of the fourth switching processing). Then, in the block B14 of the fourth switching processing, considering the characteristics of the clutch 331, the input value B (motor torque immediately before the connection of the first clutch 331) is gradually switched to the input value A (output value of the third switching processing). This prevents an excessive load on the first clutch 331.

Conversely, the operation will be described in which while the hull 1 is navigating in the hybrid propulsion mode, when the engine (first power source 31) is disconnected and the propulsion mode is switched to the motor propulsion mode, that is, when the first clutch 331 is disconnected. First, in the hybrid propulsion mode, the block B2 of the second switching processing in FIG. 17, the block B13 of the third switching processing, the block B14 of the fourth switching, and the block B15 of the fifth switching processing in FIG. 18 output the input value A as the output value. Other than that, the block B1 of the first switching processing outputs the input value B as the output value.

From this state, the output value of the block B13 of the third switching processing is gradually switched from the input value A to the input value B, and thus the engine (the torque of the first power source 31) is gradually assisted by the motor (second power source 32), thereby gradually lightening the engine load. In doing so, in the block B13 of the third switching processing, the input value A (torque indication for hybrid) is gradually switched to the input value B (engine torque immediately before disconnection of the first clutch 331), and thus the torque covered by the motor (second power source 32) side is gradually increased. When the assisting in the motor is completed, the first clutch 331 is disconnected, that is, switching from the transmission state to the disconnected state is performed. In doing so, the output value of the block B15 of the fifth switching processing is switched from the input value A to the input value B. Here, since the rpm control is a PID (Proportional-Integral-Differential) control, and therefore at the time of switching the block B15 of the fifth switching processing, the controller determines the initial value of integration on the basis of the immediately preceding output torque.

However, the control system illustrated in FIGS. 17, 18, and 19 is merely an example, and for example, the combining ratio $\alpha$ may be determined by other methods.

[4.3.1] Overall Processing

The control method according to this embodiment is used for the ship 10 equipped with the plurality of power sources 31 and 32 including an engine (first power source 31) and a motor (second power source 32). The ship 10 has the plurality of propulsion modes in which the power source 31, 32 used for propulsion of the hull 1 is different between the plurality of power sources 31 and 32. Furthermore, the ship 10 is provided with a meshing clutch (second clutch 332) between the motor (second power source 32) and an other device including at least one of the output section 4 that generates a propulsive force of the hull 1 and the engine (first power source 31).

The control method according to this embodiment includes setting, before the motor side revolving body 332C and the other side revolving bodies 332A and 332B are fitted, an rpm difference between the motor side revolving body 332C and the other side revolving bodies 332A and 332B by controlling the rpm of the motor. Here, the motor side revolving body 332C is a revolving body on the motor (second power source 32) side of the revolving bodies of the second clutch 332. The other side revolving bodies 332A and 332B are revolving bodies on the other device (at least one of the output section 4 and the first power source 31) side of the revolving bodies of the second clutch 332.

In other words, when the second clutch 332 switches from the disconnected state to the first transmission state (or the second transmission state) due to the switching of the propulsion mode of the ship 10, the motor rpm processor 24 of the ship control system 2 sets an rpm difference between the motor side revolving body 332C and the other side revolving body 332A (or 332B) by controlling the rpm of the motor (second power source 32). In doing so, the motor rpm processor 24 controls the rpm of the second power source 32 (motor) to thereby provide an rpm difference between the motor side revolving body 332C and the other side revolving body 332A (or 332B).

In this manner, in the control method according to this embodiment, when the meshing clutch (second clutch 332) is fitted due to the switching of the propulsion mode of the ship 10, it is possible to positively apply an rpm difference between the motor side revolving body 332C and the other side revolving bodies 332A and 332B. This makes it easier for the second clutch 332 to be fitted as compared with the case where the motor side revolving body 332C and the other side revolving bodies 332A and 332B revolve at a constant speed. Therefore, for example, it is no longer necessary to return the operation acceptor 51 (operating lever) to the neutral position each time the second clutch 332 is fitted, and thus there is the advantage that operability can be improved when switching the propulsion mode.

[4.3.2] Specific Processing

Hereinafter, the processing mainly executed by the motor rpm processor 24 when the second clutch 332 is fitted will be described in more detail with reference to FIGS. 23 and 24. This section describes the operation when the propulsion mode of the ship 10 switches from the engine propulsion mode to the hybrid propulsion mode (high speed).

Figure 23A:
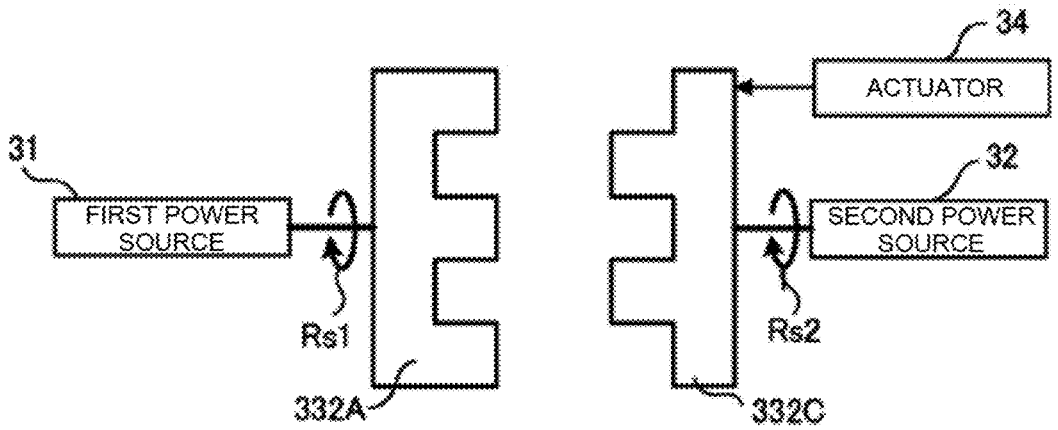
FIGS. 23A to 23C are schematic diagrams illustrating the operation of a meshing clutch of the ship according to the first embodiment.
Figure 23B:
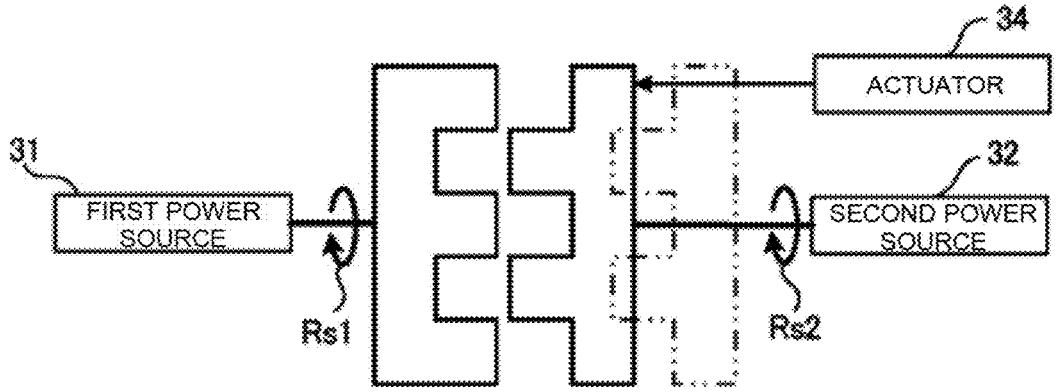
Figure 23C:
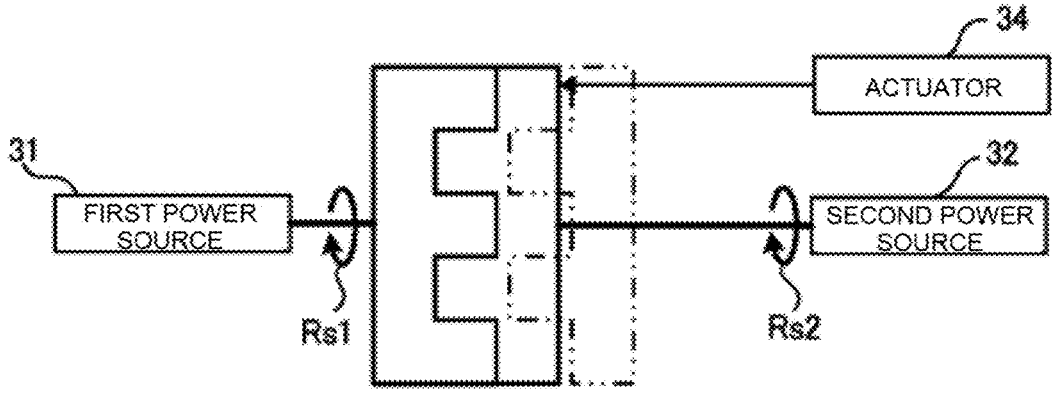

When the engine propulsion mode is switched to the hybrid propulsion mode (high speed), the mode switching processor 21 switches the second clutch 332 from the disconnected state (see FIG. 4B) to the first transmission state (see FIG. 5B). In doing so, in the second clutch 332, as illustrated in FIGS. 23A to 23C, the motor side revolving body 332C connected to the second power source 32 is fitted into the first other side revolving body 332A connected to the first power source 31 as the other device. That is, when the second clutch 332 is in the disconnected state, the motor side revolving body 332C is positioned in the "fitting/removal position" away from the first other side revolving body 332A, as illustrated in FIGS. 23A to 23C. The mode switching processor 21 moves the motor side revolving body 332C by the actuator 34 including a shifter to cause the motor side revolving body 332C to be fitted into the first other side revolving body 332A.

That is, the motor side revolving body 332C receives an external force from the actuator 34 and first moves in parallel from the fitting/removal position in a direction approaching the first other side revolving body 332A along the revolving axis, thereby moving to the "ready-to-fit position". Then, the motor side revolving body 332C receives an external force from the actuator 34 and further moves in parallel from the ready-to-fit position in a direction approaching the first other side revolving body 332A along the revolving axis, thereby moving to the "fitting position" where the motor side revolving body 332C is fitted into the first other side revolving body 332A. Here, in the meshing second clutch 332, in order for the motor side revolving body 332C to move from the ready-to-fit position to the fitting position, it is necessary that the dog of the motor side revolving body 332C is fitted well into the first other side revolving body 332A.

However, the motor side revolving body 332C and the first other side revolving body 332A are both revolving. Therefore, if an rpm Rs1 of the first other side revolving body 332A and an rpm Rs2 of the motor side revolving body 332C match, the dog of the motor side revolving body 332C interferes with the first other side revolving body 332A, and there is a possibility that the motor side revolving body 332C cannot move from the ready-to-fit position to the fitting position indefinitely.

In contrast, in the control method according to this embodiment, by controlling the rpm of the second power source 32 (motor), the rpm Rs2 of the motor side revolving body 332C is shifted to the high speed side or the low speed side with respect to the rpm Rs1 of the other side revolving body 332A to thereby provide an rpm difference between both. That is, an rpm difference (Rs1−Rs2) is applied between the rpm Rs2 of the motor side revolving body 332C and the rpm Rs1 of the other side revolving body 332A. Therefore, when the motor side revolving body 332C moves from the ready-to-fit position to the fitting position, the rpm difference makes it easier for the dog of the motor side revolving body 332C to be fitted into the first other side revolving body 332A. Consequently, the second clutch 332 is easily fitted.

In this manner, the rpm difference between the motor side revolving body 332C and the other side revolving body 332A is applied for the purpose of assisting the fitting of the second clutch 332. Therefore, it is preferable that the rpm difference is set so as to fulfill the following condition. The condition includes at least one of that the time required for fitting the motor side revolving body 332C and the other side revolving body 332A is within a desired time and that the probability of fitting is greater than a desired probability. By setting the rpm difference in this way, the time required for fitting the motor side revolving body 332C and the other side revolving body 332A is within a desired time (e.g., a few seconds) or the probability of fitting is greater than a desired probability, making the second clutch 332 to be easily fitted.

In this embodiment, the rpm difference is changed in accordance with the rpm Rs1 of the other side revolving body 332A. That is, the rpm difference between the motor side revolving body 332C and the other side revolving body 332A is not constant, and may change in accordance with the rpm Rs1 of the other side revolving body 332A. Therefore, an rpm difference at which the motor side revolving body 332C is more easily fitted is set in accordance with the rpm Rs1 of the other side revolving body 332A, and the second clutch 332 is thereby easier to be fitted. As an example, when the rpm Rs1 of the other side revolving body 332A is 750 rpm, the rpm of the motor side revolving body 332C is controlled to 700 rpm to thereby apply an rpm difference (Rs1−Rs2) of 50 rpm.

Figure 24:
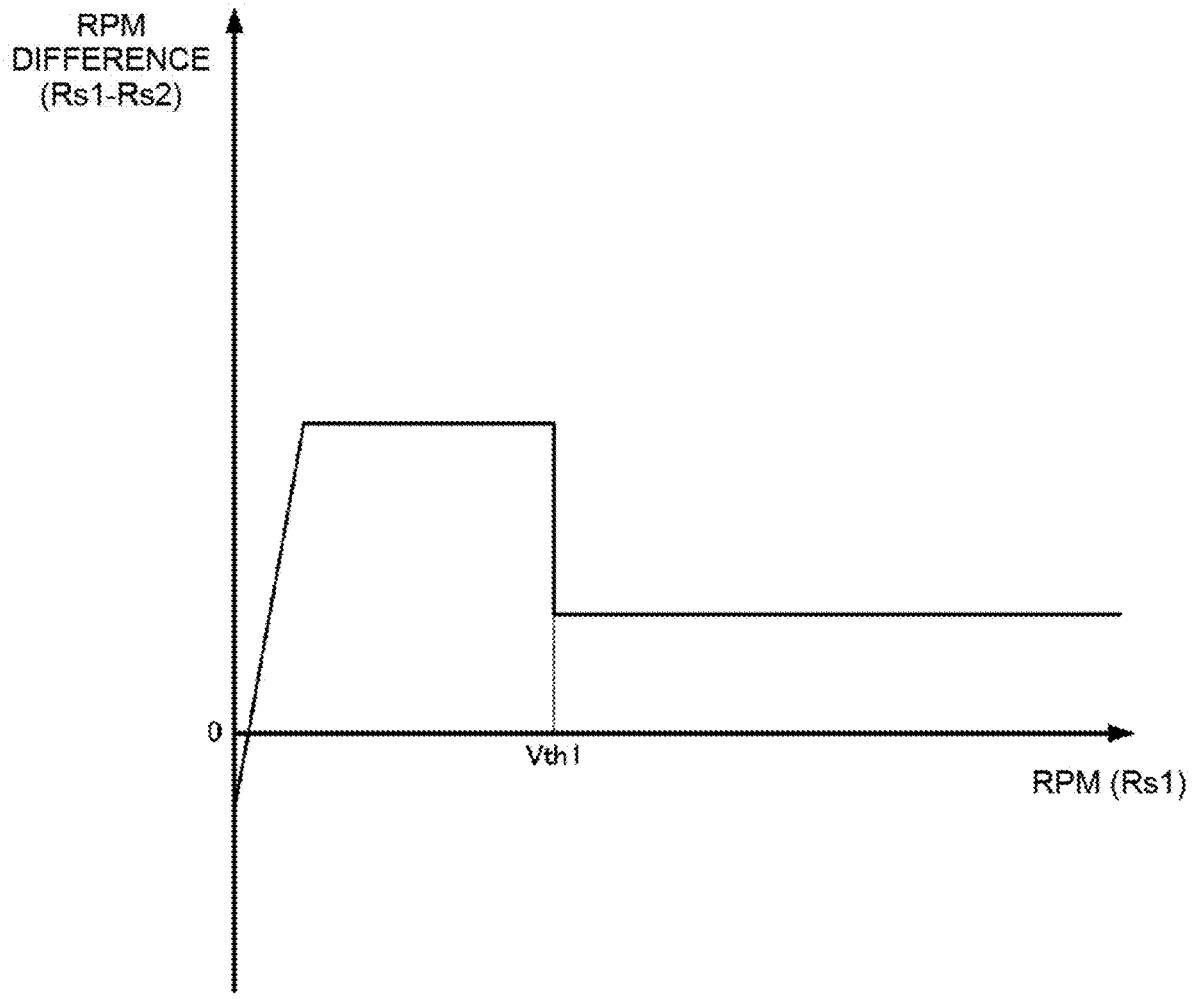
FIG. 24 is a graph illustrating an example of the relation between the rpm of the other side revolving body used in the ship control system according to the first embodiment and a difference in the rpm.

In this embodiment, in particular, as illustrated in FIG. 24, when the rpm Rs1 of the other side revolving body 332A is lower than a determination value Vth1, the rpm difference (Rs1−Rs2) is increased as compared with the case where the rpm Rs1 of the other side revolving body 332A is equal to or higher than the determination value Vth1. In other words, if the rpm Rs1 of the other side revolving body 332A is equal to or higher than the determination value Vth1, the rpm difference is smaller as compered with the case where the rpm Rs1 of the other side revolving body 332A is lower than the determination value Vth1. FIG. 24 is a graph illustrating an example of a relation between an rpm Rs1 and an rpm difference, where the horizontal axis is the rpm Rs1 of the other side revolving body 332A and the vertical axis is the rpm difference (Rs1−Rs2). Here, the determination value Vth1 is, for example, the rpm Rs1 of the other side revolving body 332A when the first power source 31 is in a substantially idling state, and is, for example, approximately 100 rpm.

According to this configuration, for example, when the output of the first power source 31 is at low rpm, the rpm difference (Rs1−Rs2) can be increased to make the second clutch 332 easier to be fitted. In FIG. 24, if the rpm Rs1 is equal to or higher than the determination value Vth1, the rpm difference is constant, but not limited to this, and for example, may change in accordance with the rpm Rs1 in the area of equal to or higher than the determination value Vth1.

Furthermore, the control method according to this embodiment switches the positive and negative of the rpm difference in accordance with the drive state of the other side revolving body 332A. Here, as an example, the rpm difference is defined as a value (Rs1−Rs2) obtained by subtracting the rpm Rs2 of the motor side revolving body 332C from the rpm Rs1 of the other side revolving body 332A. Therefore, if the rpm Rs2 is lower than the rpm Rs1 (if the speed is low), the rpm difference will be "positive", and if the rpm Rs2 is higher than the rpm Rs1 of the speed is high), the rpm difference will be "negative". In other words, if the rpm difference is "positive", the torque of the motor side revolving body 332C acts in the direction of decelerating the other side revolving body 332A, and if the rpm difference is "negative", the torque of the motor side revolving body 332C acts in the direction of accelerating the other side revolving body 332A.

More specifically, as illustrated in FIG. 24, in a state where the other side revolving body 332A is substantially stopped, the rpm difference becomes "negative", and in a state where the other side revolving body 332A revolves at a certain rpm Rs1 or higher, the rpm difference becomes "positive", and the positive and negative of the rpm difference is switched in accordance with the drive state. As a result, for example, in a state where the other side revolving body 332A is revolving, the torque of the motor side revolving body 332C is applied in the direction of decelerating the other side revolving body 332A, and it is possible to prevent the other side revolving body 332A from being excessively accelerated.

Further, in the control method according to this embodiment, before the start of fitting the motor side revolving body 332C and the other side revolving body 332A, while the rpm of the motor (second power source 32) is controlled so as to set the rpm difference, the motor side revolving body 332C and the other side revolving body 332A are brought close to each other. Specifically, before the start of fitting, while the rpm of the motor (second power source 32) is controlled, the actuator 34 moves the motor side revolving body 332C from the "fitting/removal position" to the "ready-to-fit position" in FIGS. 23A to 23C. This causes the motor side revolving body 332C to approach the other side revolving body 332A by a predetermined distance while the rpm is controlled so as to generate an rpm difference. However, since the motor side revolving body 332C and the other side revolving body 332A do not come into contact with each other at the ready-to-fit position, fitting of both has not started yet, and fitting starts only after the motor side revolving body 332C starts moving from the "ready-to-fit position" to the "fitting position". This reduces the time required for the second clutch 332 to be fitted and allows for smoother switching between propulsion modes.

Further, in the control method according to this embodiment, the torque of the motor (second power source 32) is controlled during the torque control period after the fitting of the motor side revolving body 332C and the other side revolving body 332A is started. In short, in this embodiment, the motor rpm processor 24 starts fitting after giving an rpm difference between the motor side revolving body 332C and the other side revolving body 332A by controlling the rpm of the second power source 32 (motor), and then switches the control of the second power source 32 (motor) from the rpm control to the torque control. If the period during which the motor controller 23 controls the torque of the second power source 32 (motor) is defined as the "torque control period", in a state where the rpm difference is given by the rpm control of the second power source 32 (motor), the torque control period starts after the motor side revolving body 332C starts moving from the "ready-to-fit position" to the "fitting position". As a result, it is possible to prevent sudden torque transmission (torque fluctuation) between the second power source 32 (motor) and the other device (e.g., the first power source 31) immediately after the motor side revolving body 332C is fitted into the other side revolving body 332A.

In this embodiment, in particular, during the torque control period, the torque of the motor (second power source 32) is maintained within a predetermined range at least until the fitting of the motor side revolving body 332C and the other side revolving body 332A is completed. That is, in the torque control period after the fitting starts, the torque of the second power source 32 is maintained within a predetermined range at least until the fitting is completed when the motor side revolving body 332C reaches the "fitting position". Here, the "predetermined range" can be freely set by the lower limit value and the upper limit value. For example, by setting the lower limit value and the upper limit value of a predetermined range to the same value, the width of the predetermined range can be set to 0 (zero), and the predetermined range can be set in a pinpoint manner. In this case, the predetermined range is synonymous with a predetermined value, and thus the torque of the motor (second power source 32) is maintained at the predetermined value (maintained constant) during the torque control period. As a result, it is possible to prevent sudden torque transmission (torque fluctuation) between the second power source 32 (motor) and the other device (e.g., the first power source 31) in the process in which the motor side revolving body 332C is fitted into the other side revolving body 332A. Furthermore, by maintaining the torque of the motor (second power source 32) within a predetermined range, it is possible to suppress the deviation of the rpm difference between the motor side revolving body 332C and the other side revolving body 332A due to the switching of the control of the motor (second power source 32) from the rpm control to the torque control. That is, in the small amount of time after the start of the torque control period until the motor side revolving body 332C reaches the "fitting position", the rpm difference set by the rpm control of the motor (second power source 32) is less likely to deviate from the target value.

In the section of "[4.3.2] Specific Processing", the operation when the propulsion mode of the ship 10 switches from the engine propulsion mode to the hybrid propulsion mode (high speed) has been described as an example, but the present invention is not limited to this. For example, the same processing is applied when the propulsion mode of the ship 10 switches from the engine propulsion mode to the motor propulsion mode. When the engine propulsion mode is switched to the motor propulsion mode, the mode switching processor 21 switches the second clutch 332 from the disconnected state (see FIG. 4B) to the second transmission state (see FIG. 4A). In doing so, in the second clutch 332, the motor side revolving body 332C connected to the second power source 32 is fitted into the second other side revolving body 332B connected to the output section 4 as the other device. That is, if the other side revolving body 332A described above is read as the other side revolving body 332B, the above control regarding the fitting of the motor side revolving body 332C and the other side revolving body 332A can also be applied to the fitting of the motor side revolving body 332C and the other side revolving body 332B.

[4.3.3] Flowchart

Figure 25:
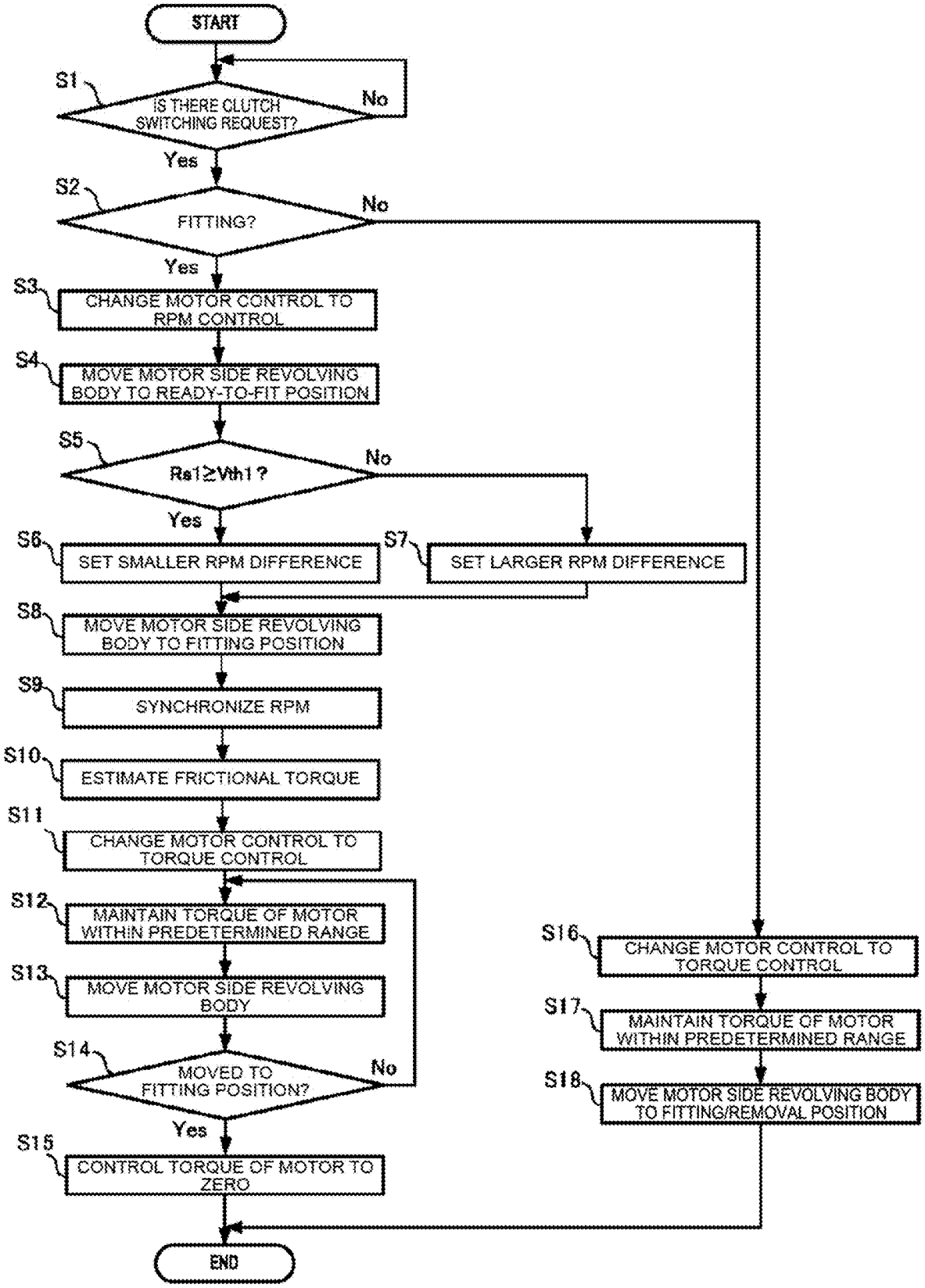
FIG. 25 is a flowchart of an example of the operation of the ship control system according to the first embodiment.

Next, the overall flow of the processing for the control method of the ship 10 will be described with reference to the flowchart in FIG. 25.

More specifically, in the control method according to this embodiment, the ship control system 2 determines whether there is a clutch switching request instructing the switching of the second clutch 332 (S1). As an example, when the propulsion mode of the ship 10 is switched from the engine propulsion mode to the hybrid propulsion mode (high speed), or the like, it is necessary to switch the second clutch 332 with the switching of the propulsion mode, and the clutch switching request is made. Therefore, if switching of the propulsion mode with the switching of the second clutch 332 has been performed, the ship control system 2 determines that there is a clutch switching request (S1: Yes), and shifts the processing to step S2. On the other hand, if switching of the propulsion mode with the switching of the second clutch 332 has not been performed, the ship control system 2 determines that there is no clutch switching request (S1: No), and repeatedly executes step S1.

In step S2, the ship control system 2 determines whether the clutch switching request is a request for fitting the second clutch 332. For example, when the propulsion mode is switched from the engine propulsion mode to the hybrid propulsion mode (high speed), the second clutch 332 is switched from the disconnected state to the first transmission state, and therefore the ship control system 2 determines that the clutch switching request is "fitting" (S2: Yes), and the shifts the processing to step S3. At this point, the motor side revolving body 332C is in the fitting/removal position. On the other hand, when the propulsion mode is switched from the hybrid propulsion mode (high speed) to the engine propulsion mode, the second clutch 332 is switched from the first transmission state to the disconnected state, and therefore the ship control system 2 determines that the clutch switching request is not "fitting" (i.e., the clutch switching request is "fitting/removal") (S2: No), and the shifts the processing to step S16. At this point, the motor side revolving body 332C is in the fitting position.

In step S3, the ship control system 2 changes the control of the second power source 32 (motor) by the motor controller 23 to the rpm control. After that, in step S4, the ship control system 2 controls the actuator 34 to move the motor side revolving body 332C from the fitting/removal position to the ready-to-fit position. In doing so, the ship control system 2 determines whether the rpm Rs1 of the other side revolving body 332A (or 332B) is equal to or higher than the determination value Vth1 (S5). If the rpm Rs1 is equal to or higher than the determination value Vth1 (S5: Yes), the ship control system 2 shifts the processing to step S6 and sets a smaller rpm difference. If the rpm Rs1 is not equal to or higher than the determination value Vth1 (S5: No), the ship control system 2 shifts the processing to step S7 and sets a larger rpm difference. That is, the rpm difference is determined in accordance with whether the rpm Rs1 is lower than the determination value Vth1 (see FIG. 24).

After that, in step S8, the ship control system 2 controls the actuator 34 to move the motor side revolving body 332C from the ready-to-fit position toward the fitting position. Then, when the motor side revolving body 332C begins to fit into the other side revolving body 332A (or 332B), the rpm Rs2 of the motor side revolving body 332C and the rpm Rs1 of the other side revolving body 332A (or 332B) are naturally synchronized (matched) (S9). In doing so, the ship control system 2 estimates the frictional force (frictional torque) between the rpm Rs2 of the motor side revolving body 332C and the other side revolving body 332A (or 332B) (S10). Specifically, the ship control system 2 estimates the frictional force on the basis of the rpm of the second power source 32 (motor) when the rpm difference between the motor side revolving body 332C and the other side revolving body 332A (or 332B) reaches 0 (zero).

After that, in step S11, the ship control system 2 changes the control of the second power source 32 (motor) by the motor controller 23 from the rpm control to the torque control. That is, after the fitting starts, as the torque control period, the ship control system 2 controls the torque of the motor (second power source 32). In doing so, the ship control system 2 maintains the torque of the second power source 32 (motor) within a predetermined range (S12). Here, the "predetermined range" is set to a range suitable for torque compensation in accordance with the frictional force estimated in step S10. Furthermore, it is preferable to output torque continuously to avoid discontinuities (i.e., sudden fluctuations) in the torque at this time.

Then, in step S13, the ship control system 2 controls the actuator 34 to further move the motor side revolving body 332C toward the fitting position. In step S14, the ship control system 2 determines whether the motor side revolving body 332C has moved to the fitting position. When the motor side revolving body 332C has reached the fitting position, the ship control system 2 determines that the motor side revolving body 332C has moved to the fitting position, that is, the fitting is completed (S14: Yes), and shifts the processing to step S15. On the other hand, when the motor side revolving body 332C has not reached the fitting position, the ship control system 2 determines that the motor side revolving body 332C has not moved to the fitting position, that is, the fitting is not completed (S14: No), and returns the processing to step S12.

In step S15, the ship control system 2 controls the torque of the second power source 32 (motor) to 0 (zero torque) (S12). That is, when the fitting of the second clutch 332 is completed, it is not necessary to perform torque control for keeping the rpm constant, and thus the second power source 32 is switched to zero torque. With this, the ship control system 2 ends a series of processing related to the fitting of the second clutch 332.

On the other hand, if the clutch switching request is "fitting/removal" (S2: No), in step S16, the ship control system 2 changes the control of the second power source 32 (motor) by the motor controller 23 from the rpm control to the torque control. However, for example, in a state where the propulsion mode is the hybrid propulsion mode (high speed), the second power source 32 may be originally torque controlled. In such a case, in step S16, the ship control system 2 maintains the control of the second power source 32 (motor) by the motor controller 23 in the torque control. Then, the ship control system 2 maintains the torque of the second power source 32 (motor) within a predetermined range (S17). Furthermore, in step S18, the ship control system 2 controls the actuator 34 to move the motor side revolving body 332C from the fitting position toward the fitting/removal position. When the motor side revolving body 332C moves to the fitting/removal position, the ship control system 2 ends a series of processing related to the fitting/removal of the second clutch 332.

The ship control system 2 repeats the processing of the above steps S1 to S18. However, the flowchart illustrated in FIG. 25 is merely an example, and the processing may be added or omitted as appropriate, or the order of processing may be swapped as appropriate. For example, when the dogs of the second clutch 332 come into contact (interfere with each other) and a state where the motor side revolving body 332C cannot move to the fitting position (S14: No) continues for a standby time, the ship control system 2 may return the processing from step S14 to step S4. This allows the ship control system 2 to move the motor side revolving body 332C once to the ready-to-fit position to eliminate interference between the dogs, and then again to move the motor side revolving body 332C from the ready-to-fit position toward the fitting position.

[5] Variations

Hereinafter, variations of the first embodiment will be described. The variations described below can be applied in combination as appropriate.

The ship control system 2 according to the present disclosure includes a computer system. The computer system includes, as main components, at least one processor and at least one memory as hardware. When the processor executes a program recorded in the memory of the computer system, functions as the ship control system 2 in the present disclosure are implemented. The program may be recorded in the memory of the computer system in advance, may be provided through an electric communication line, or may be recorded on a non-transitory recording medium, such as a memory card, an optical disk, a hard disk drive, or the like, that is readable by the computer system. Further, some or all of the functional parts included in the ship control system 2 may be configured by an electronic circuit.

Further, it is not a required configuration for the ship control system 2 that at least a part of the functions of the ship control system 2 are integrated in one housing, and the components of the ship control system 2 may be distributed in a plurality of housings. Conversely, functions that are distributed in the plurality of devices (such as the ship control system 2 and the operation device 5) in the first embodiment may be integrated in one housing.

Furthermore, at least a part of the ship control system 2 is not limited to being mounted on the hull 1, but may be installed separately from the hull 1. As an example, when the ship control system 2 is embodied by a server device provided separately from the hull 1, communication between the server device and the hull 1 (communication device) enables the ship 10 (hull 1) to be controlled by the ship control system 2. At least a part of the functions of the ship control system 2 may be implemented by a cloud (cloud computing) or the like.

Further, the ship 10 is not limited to pleasure boats, but may be commercial vessels including cargo ships and passenger ships, work vessels including tugboats and salvage boats, special vessels including meteorological observation vessels and training vessels, fishing vessels, naval vessels, and the like. Furthermore, the ship 10 is not limited to a manned type with a navigator on board, but may also be an unmanned type that can be remotely operated by a person (navigator) or autonomously operated.

Further, the first power source 31 is not limited to a diesel engine, but may be, for example, an engine other than a diesel engine, or a power source (motor or the like) other than the engine. The second power source 32 is also not limited to an AC motor, but may be, for example, a DC motor, or a power source other than a motor (engine or the like). As an example, the first power source 31 may be a motor and the second power source 32 may be an engine. Furthermore, the first power source 31 and the second power source 32 may both be the same type of power source as the engine (or motor), and even in this case, it is preferable that the output characteristics of the first power source 31 and the second power source 32 are different, for example, due to a difference in displacement.

Further, the ship 10 should be equipped with a plurality of power sources 31 and 32 in the hull 1, and for example, may be equipped with three or more power sources, such as having a third power source in addition to the first power source 31 and the second power source 32.

Further, the operation acceptor 51 is not limited to an operating lever, but may be, for example, a stepping type operation pedal, a touch panel, a keyboard, or a pointing device. If the operation acceptor 51 includes an operation pedal, the stepping amount is the operation amount of the operation acceptor 51. Furthermore, the operation acceptor 51 may employ a voice input, a gesture input, or an input of an operation signal from another terminal.

Further, it is not required to switch the propulsion mode in response to the switching operation by the user (navigator). For example, the mode switching processor 21 of the ship control system 2 may automatically switch the propulsion mode in accordance with the navigation status of the hull 1 such as the current position of the hull 1 or the ship speed, the remaining capacity of the main battery 352, and the like.

Further, it is not required that the propulsion mode be switchable in the drive state, but it is only required that the propulsion mode be switchable only when the operation state of the operation acceptor 51 is the non-drive state. Conversely, it is not required that the propulsion mode be switchable in the non-drive state, but the propulsion mode may be switchable when the operation state of the operation acceptor 51 is the drive state.

Furthermore, when an output of the first power source 31 is equal to or higher than a predetermined value, it is not required to restrict switching from a mode in which the first power source 31 is used for propulsion of the hull 1 to a mode in which the first power source 31 is not used for propulsion of the hull 1. Further, it is not required that, with switching from the first mode M1 to the second mode M2, the first output value V1 be changed to the second output value V2 over the transition time T1 via the intermediate output value. Further, it is not required that, if the difference between the first output value V1 and the second output value V2 is less than an allowable value, the transition time T1 be shortened as compared with the case where the difference is equal to or more than the allowable value. It is also not required that the transition time T1 have the same length when the difference between the first output value V1 and the second output value V2 is the first value and when the difference between the first output value V1 and the second output value V2 is the second value larger than the first value.

Further, it is not required to maintain the torque of the motor (second power source 32) within a predetermined range until the first clutch 331 transitions to the transmission state during the torque control period. Further, it is not required to change the torque of the motor (second power source 32) over the transition time after the first clutch 331 transitions to the transmission state during the torque control period. Further, it is not required to change the torque of the motor (second power source 32) continuously at the transition time, but the torque of the motor (second power source 32) may be changed discontinuously (discretely). Further, it is not also required that, when the hybrid propulsion mode is switched to the motor propulsion mode, before the first clutch 331 is switched from the transmission state to the disconnected state, the torque of the motor (second power source 32) be controlled. Furthermore, it is not also required that, when the first clutch 331 is switched from the transmission state to the disconnected state, the control of the motor (second power source 32) be switched from the torque control to the rpm control.

Further, it is not also required that, when the motor propulsion mode is switched to the hybrid propulsion mode, the processing of synchronizing the rpm of the engine (first power source 31) with the rpm of the motor be enabled/disabled by the rpm of the motor (second power source 32). That is, the rpm of the engine (first power source 31) may be synchronized with the rpm of the motor regardless of the rpm of the motor (second power source 32).

Further, it is not required to switch the positive and negative of the rpm difference in accordance with the drive state of the other side revolving bodies 332A and 332B. Further, it is not also required that, before the start of fitting the motor side revolving body 332C and the other side revolving body 332A, while the rpm of the motor (second power source 32) is controlled so as to set the rpm difference, the motor side revolving body 332C and the other side revolving body 332A be brought close to each other. Further, it is not also required that the torque of the motor (second power source 32) be controlled during the torque control period after the fitting of the motor side revolving body 332C and the other side revolving body 332A is started. Furthermore, it is not also required that, during the torque control period, the torque of the motor (second power source 32) be maintained within a predetermined range at least until the fitting of the motor side revolving body 332C and the other side revolving body 332A is completed.

Further, the meshing clutch (second clutch 332) may be provided between the other device and the motor (second power source 32), and it is not required that the other device be both the output section 4 and the engine (first power source 31). For example, the other device may be only the output section 4, and in this case, the second clutch 332 switches between the transmission state and the disconnected state of the power between the motor (second power source 32) and the output section 4.

Second Embodiment

Figure 12:
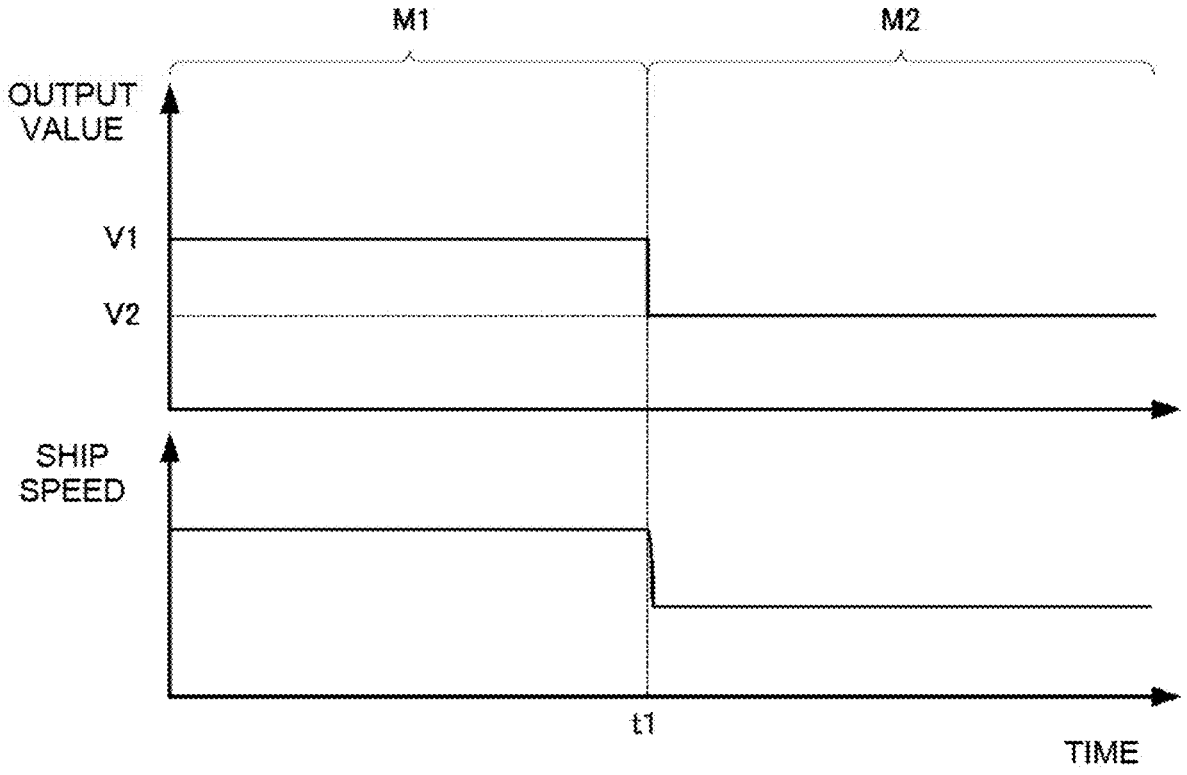
FIG. 12 is a time chart illustrating an example of output values and ship speeds with regard to a ship control system according to a second embodiment.

As illustrated in FIG. 12, a control method of the ship 10 according to this embodiment is different from the control method according to the first embodiment in that, when switching from the first mode M1 to the second mode M2, the output value is switched from the first output value V1 to the second output value V2 not via the intermediate output value. Hereinafter, the same configurations as those in the first embodiment will be denoted by the same signs, and the explanation will be omitted as appropriate.

More specifically, in this embodiment, with the switching from the first mode M1 to the second mode M2, the output value is switched directly from the first output value V1 corresponding to the operation amount in the first mode M1 to the second output value V2 corresponding to the operation amount in the second mode M2. FIG. 12 is a graph illustrating the output value (rpm of the propeller) in the upper part and the ship speed in the lower part with the horizontal axis as the time axis. In FIG. 12, as an example, it is assumed that the first mode M1 is the engine propulsion mode and the second mode M2 is the motor propulsion mode. Therefore, even if the operation amount of the operation acceptor 51 is the same, the output value decreases from the first output value V1 to the second output value V2 (<V1) by switching from the first mode M1 (engine propulsion mode) to the second mode M2 (motor propulsion mode).

In this embodiment, no intermediate output value is set, and therefore the output value drops abruptly (steeply) from the first output value V1 to the second output value V2. As a result, the change in ship speed due to the switching of the propulsion mode becomes steeper as compared with the first embodiment.

The configuration of the second embodiment can be employed in combination with various configurations (including variations) described in the first embodiment as appropriate.

Third Embodiment

Figure 20:
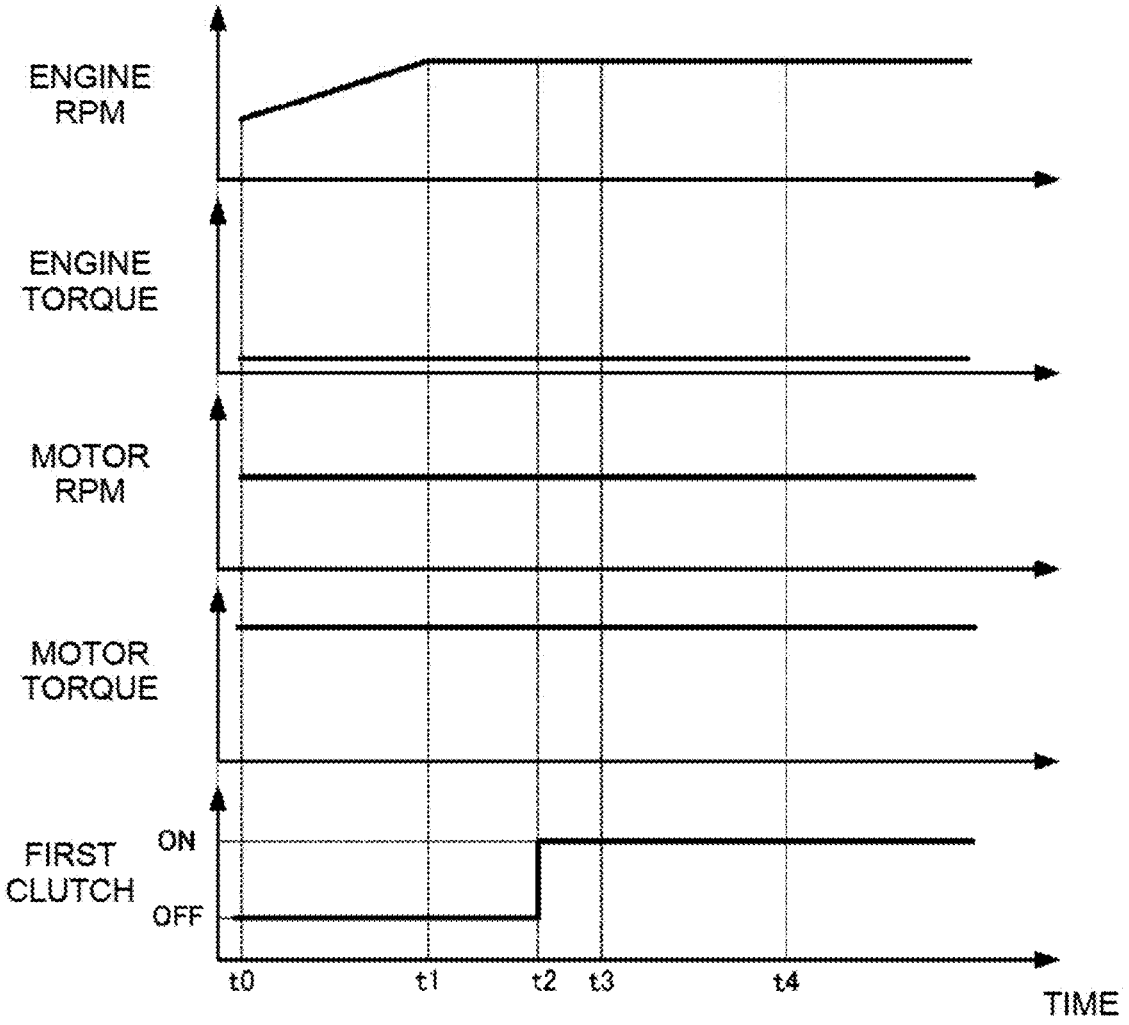
FIG. 20 is a timing chart illustrating an example of the processing when a first clutch is connected in a ship control system according to a third embodiment.
Figure 21:
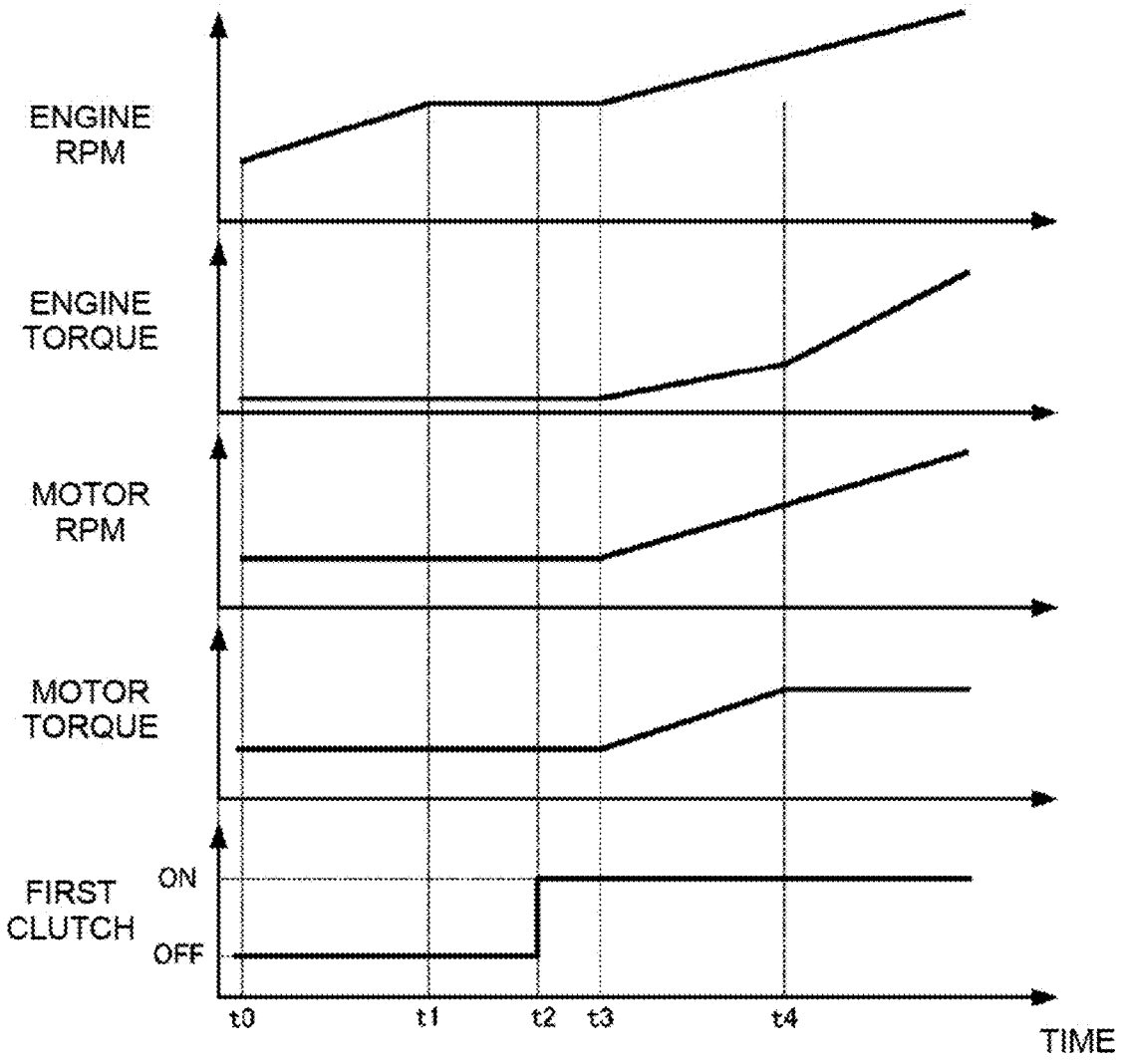
FIG. 21 is a timing chart illustrating an example of the processing when the first clutch is connected in the ship control system according to the third embodiment.
Figure 22:
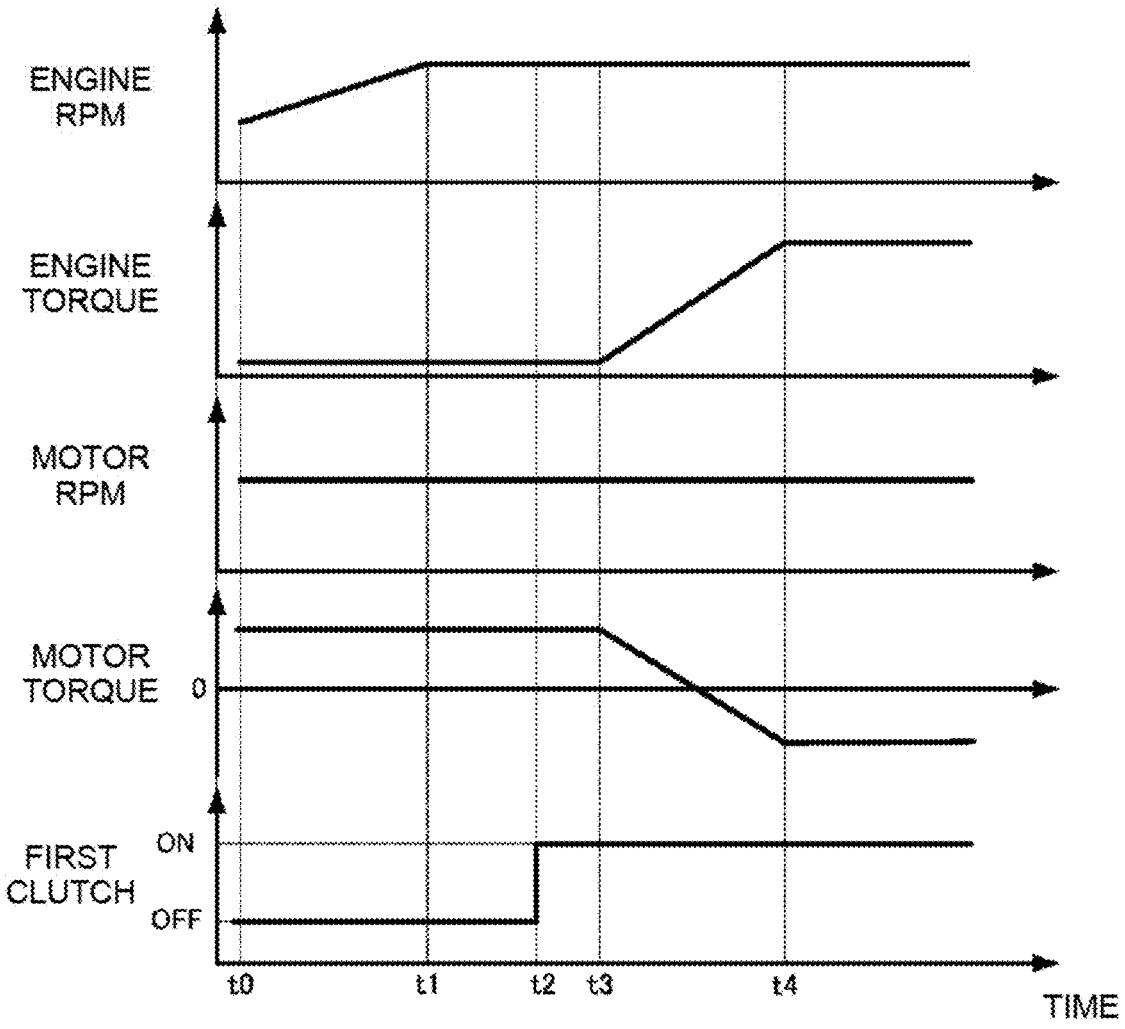
FIG. 22 is a timing chart illustrating an example of the processing when the first clutch is connected in the ship control system according to the third embodiment.

A control method of the ship 10 according to this embodiment is different from the control method according to the first embodiment in that the processing related to the connection of the first clutch 331 changes in accordance with the sub-mode of the hybrid propulsion mode. Hereinafter, the same configurations as those in the first embodiment will be denoted by the same signs, and the explanation will be omitted as appropriate. FIGS. 20 to 22 are all an example of a timing chart when the first clutch 331 is connected, which illustrates the engine rpm, engine torque, motor rpm, motor torque, and state of the first clutch 331.

In this embodiment, as an example, three sub-modes are set up in the hybrid propulsion mode: "zero torque mode," "assist mode," and "power generation mode". The zero torque mode is a mode in which the motor torque is reduced to zero by substituting all of the torque of the motor (second power source 32) with the engine (first power source 31). The assist mode is a mode in which the output of the engine (first power source 31) is used to assist the motor (second power source 32). The power generation mode is a mode in which the output of the engine (first power source 31) is used to charge the main battery 352. Further, the processing related to the connection of the first clutch 331 when the motor propulsion mode is switched to the hybrid propulsion mode is different for each sub-mode of the hybrid propulsion mode.

First, the processing related to the connection of the first clutch 331 when the motor propulsion mode is switched to the hybrid propulsion mode of the zero torque mode will be described. In this case, the processing is roughly the same as that described with reference to FIG. 14 in the first embodiment. Specifically, over the transition time from time t3 to time t4, the torque of the second power source 32 (motor) is gradually reduced until the motor torque reaches 0 (zero) at time t4 in FIG. 14.

Next, the processing related to the connection of the first clutch 331 when the motor propulsion mode is switched to the hybrid propulsion mode of the assist mode will be described with reference to FIG. 20. In this case, as illustrated in FIG. 20, at time t2, even after the state of the first clutch 331 is switched from the disconnected state (OFF) to the transmission state (ON), the torque of the motor (second power source 32) at time t2 when the connection of the first clutch 331 is started is maintained as the motor torque. Furthermore, even after time t3 when the first clutch 331 is connected, unless the target torque of the motor (second power source 32) at that time changes, the torque of the motor at time t2 is maintained.

Alternatively, even in the same assist mode, if the target torque of the motor (second power source 32) is increased, such as when the hull 1 is further accelerated in the hybrid propulsion mode, the motor torque will be as illustrated in FIG. 21. The same is true for FIG. 21 in that, at time t2, even after the state of the first clutch 331 is switched from the disconnected state (OFF) to the transmission state (ON), the torque of the motor (second power source 32) at time t2 when the connection of the first clutch 331 is started is maintained as the motor torque. However, after time t3 when the first clutch 331 is connected, the torque of the motor (second power source 32) is varied over the transition time so as to be close to the target torque. In the example of FIG. 21, the motor torque increases gradually (and continuously) over the transition time from time t3 to time t4. In this case, the engine torque, engine rpm, and motor rpm increase continuously after time t3, accelerating the hull 1.

Next, the processing related to the connection of the first clutch 331 when the motor propulsion mode is switched to the hybrid propulsion mode of the power generation mode will be described with reference to FIG. 22. In this case, as illustrated in FIG. 22, at time t2, even after the state of the first clutch 331 is switched from the disconnected state (OFF) to the transmission state (ON), the torque of the motor (second power source 32) at time t2 when the connection of the first clutch 331 is started is maintained as the motor torque. Then, after the time t3 when the first clutch 331 is connected, the torque of the second power source 32 (motor) torque is gradually reduced. That is, the motor controller 23 gradually reduces the torque of the second power source 32 (motor) over the transition time from time t3 to time t4. In doing so, the motor torque decreases from "positive" to "negative". Here, the motor torque in the state where the second power source 32 (motor) is driving the output section 4 as a load is "positive", and conversely, the motor torque in the state where the output section 4 is driving the second power source 32 (motor) as a load is "negative".

That is, in the example of FIG. 22, after the motor torque falls below 0 (zero) and becomes "negative", by using the second power source 32 as a generator, the electrical energy (AC power) generated when the second power source 32 is revolved by an external force can be used to charge the main battery 352 by the drive circuit 351.

As described above, when the hybrid propulsion mode has various sub-modes, the processing related to the connection of the first clutch 331 varies in accordance with the sub-mode. Further, in some sub-modes, as in the above assist mode (during acceleration), after the clutch (first clutch 331) transitions to the transmission state, the torque of the motor (second power source 32) is increased over the transition time in some cases.

The configuration of the third embodiment can be employed in combination with various configurations (including variations) described in the first and second embodiments as appropriate.

Fourth Embodiment

A control method of the ship 10 according to this embodiment is different from the control method according to the first embodiment in that the rpm difference is constant regardless of the rpm Rs1 of the other side revolving bodies 332A and 332B. Hereinafter, the same configurations as those in the first embodiment will be denoted by the same signs, and the explanation will be omitted as appropriate.

More specifically, in this embodiment, whether the rpm Rs1 of the other side revolving bodies 332A and 332B is lower than the determination value Vth1 or equal to or higher than the determination value Vth1, the rpm difference between the motor side revolving body 332C and the other side revolving bodies 332A and 332B is constant. Therefore, step S5 and one of steps S6 and S7 of the flowchart in FIG. 25 described in the first embodiment are omitted. By keeping the rpm difference constant in this embodiment, the second clutch 332 can be easily fitted while making the processing simpler.

The configuration of the fourth embodiment can be employed in combination with various configurations (including variations) described in the first to third embodiments as appropriate.

REFERENCE SIGNS LIST

1 hull
2 ship control system
4 output section
10 ship
24 adjustment processor
25 change processor
31 first power source (engine)
32 second power source (motor)
331 (first) clutch
332 (second) clutch
332A, 332B other side revolving body
332C motor side revolving body
51 operation acceptor
M1 first mode
M2 second mode
Rs1 rpm of the other side revolving body
Rs2 rpm of motor side revolving body
T1 transition time
V1 first output value
V2 second output value
Vth1 determination value

The invention claimed is:

1. A ship control method used for a ship including a plurality of power sources including a first power source and a second power source, and having a plurality of propulsion modes in which a power source used for propulsion of a hull is different among the plurality of power sources, the ship control method comprising:

adjusting an output value related to a propulsive force of the hull to a value corresponding to an operation amount of an operation acceptor; and changing a correspondence relation between the operation amount and the output value in accordance with the propulsion modes.

2. The ship control method according to claim 1, further comprising switching the propulsion modes in response to a switching operation by a user.

3. The ship control method according to claim 1, wherein:

an operation state of the operation acceptor includes a drive state corresponding to the output value whose operation amount is equal to or more than a threshold value and a non-drive state corresponding to the output value whose operation amount is less than the threshold value, and the propulsion modes can be switched at least in the drive state.

4. The ship control method according to claim 1, wherein:

an operation state of the operation acceptor includes a drive state corresponding to the output value whose operation amount is equal to or more than a threshold value and a non-drive state corresponding to the output value whose operation amount is less than the threshold value, and the propulsion modes can be switched at least in the non-drive state.

5. The ship control method according to claim 1, further comprising restricting, when an output of the first power source is equal to or higher than a predetermined value, switching from a mode in which the first power source is used for propulsion of the hull to a mode in which the first power source is not used for propulsion of the hull, among the plurality of propulsion modes.

6. The ship control method according to claim 1, further comprising, with switching from a first mode to a second mode among the plurality of propulsion modes, assigning, to the operation amount, an intermediate output value between a first output value corresponding to the operation amount in the first mode and a second output value corresponding to the operation amount in the second mode.

7. The ship control method according to claim 6, wherein with the switching from the first mode to the second mode, the first output value is changed to the second output value over a transition time via the intermediate output value.

8. The ship control method according to claim 7, wherein if a difference between the first output value and the second output value is less than an allowable value, the transition time is shortened as compared with a case where the difference is equal to or more than the allowable value.

9. The ship control method according to claim 7, wherein the transition time is same when a difference between the first output value and the second output value is a first value and when the difference is a second value larger than the first value.

10. A ship control method used for a ship including a plurality of power sources including an engine and a motor, having a plurality of propulsion modes in which a power source used for propulsion of a hull is different among the plurality of power sources, and being provided with a clutch at least between the engine and an output section that outputs a propulsive force of the hull, the plurality of propulsion modes including a hybrid propulsion mode in which both the engine and the motor are used for propulsion of the hull, and a motor propulsion mode in which the motor is used for propulsion of the hull, the ship control method comprising:

when the motor propulsion mode is switched to the hybrid propulsion mode, synchronizing revolutions per minute of the engine with revolutions per minute of the motor before the clutch is switched from a disconnected state to a transmission state; and controlling a torque of the motor during a torque control period after the revolutions per minute is synchronized.

11. A ship control method used for a ship including a plurality of power sources including an engine and a motor, having a plurality of propulsion modes in which a power source used for propulsion of a hull is different among the plurality of power sources, and being provided with a clutch at least between the engine and an output section that outputs a propulsive force of the hull, the plurality of propulsion modes including a hybrid propulsion mode in which both the engine and the motor are used for propulsion of the hull, and a motor propulsion mode in which the motor is used for propulsion of the hull, the ship control method comprising, when the hybrid propulsion mode is switched to the motor propulsion mode, before the clutch is switched from a transmission state to a disconnected state, controlling a torque of the motor.

12. A ship control method used for a ship including a plurality of power sources including an engine and a motor, having a plurality of propulsion modes in which a power source used for propulsion of a hull is different among the plurality of power sources, and being provided with a meshing clutch between the motor and another device including at least one of an output section that generates a propulsive force of the hull and the engine, the ship control method comprising controlling revolutions per minute of the motor before a motor side revolving body on a side of the motor and another side revolving body on a side of the other device in the meshing clutch are fitted, to thereby set a difference in revolution per minute between the motor side revolving body and the other side revolving body.

13. A non-transitory, computer-readable medium storing a ship control program, which when executed by one or more processors, causes the one or more processors to execute the ship control method according to claim 1.

14. A ship control system used for a ship including a plurality of power sources including a first power source and a second power source, and having a plurality of propulsion modes in which a power source used for propulsion of a hull is different among the plurality of power sources, the ship control system comprising:

an adjustment processor configured to adjust an output value related to a propulsive force of the hull to a value corresponding to an operation amount of an operation acceptor; and a change processor configured to change a correspondence relation between the operation amount and the output value in accordance with the propulsion modes.

15. A ship control system used for a ship including a plurality of power sources including an engine and a motor, having a plurality of propulsion modes in which a power source used for propulsion of a hull is different among the plurality of power sources, and being provided with a clutch at least between the engine and an output section that outputs a propulsive force of the hull, the plurality of propulsion modes including a hybrid propulsion mode in which both the engine and the motor are used for propulsion of the hull, and a motor propulsion mode in which the motor is used for propulsion of the hull, the ship control system comprising:

an engine rpm processor configured to synchronize revolutions per minute of the engine with revolutions per minute of the motor before the clutch is switched from a disconnected state to a transmission state when the motor propulsion mode is switched to the hybrid propulsion mode; and a motor torque processor configured to control a torque of the motor during a torque control period after the revolutions per minute is synchronized.

16. A ship control system used for a ship including a plurality of power sources including an engine and a motor, having a plurality of propulsion modes in which a power source used for propulsion of a hull is different among the plurality of power sources, and being provided with a meshing clutch between the motor and another device including at least one of an output section that generates a propulsive force of the hull and the engine, the ship control system comprising a motor rpm processor configured to control revolutions per minute of the motor before a motor side revolving body on a side of the motor and another side revolving body on a side of the other device in the meshing clutch are fitted, to thereby set a difference in revolution per minute between the motor side revolving body and the other side revolving body.

17. A ship comprising:

the ship control system according to claim 14; and the hull.

* * * * *